US007076196B2

(12) United States Patent
Takahashi et al.

(10) Patent No.: US 7,076,196 B2
(45) Date of Patent: Jul. 11, 2006

(54) FIXING DEVICE AND IMAGE FORMING APPARATUS INCLUDING A TUBULAR COIL WINDING

(75) Inventors: Keisuke Takahashi, Nagoya (JP); Kenjiro Nishiwaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 160 days.

(21) Appl. No.: 10/669,300

(22) Filed: Sep. 25, 2003

(65) Prior Publication Data

US 2004/0057758 A1 Mar. 25, 2004

(30) Foreign Application Priority Data

Sep. 25, 2002 (JP) ..... 2002-279737
Sep. 26, 2002 (JP) ..... 2002-281324
Sep. 26, 2002 (JP) ..... 2002-281325

(51) Int. Cl.
*G03G 15/20* (2006.01)

(52) U.S. Cl. ..... 399/328; 399/331; 219/216; 219/619

(58) Field of Classification Search ..... None
See application file for complete search history.

(56) References Cited

U.S. PATENT DOCUMENTS

| | | | | |
|---|---|---|---|---|
| 4,570,044 | A * | 2/1986 | Kobayashi et al. | 219/619 |
| 5,666,627 | A | 9/1997 | Yamaguchi | |
| 6,122,477 | A * | 9/2000 | Parker | 399/330 |
| 6,292,648 | B1 * | 9/2001 | Higaya et al. | 399/335 |
| 6,810,230 | B1 * | 10/2004 | Imai et al. | 399/328 |

FOREIGN PATENT DOCUMENTS

| | | | |
|---|---|---|---|
| EP | 0 679 961 | A2 | 11/1995 |
| JP | A 57-120969 | | 7/1982 |
| JP | A 58-35568 | | 3/1983 |
| JP | A 58-214291 | | 12/1983 |
| JP | A 59-33476 | | 2/1984 |
| JP | A 7-295414 | | 11/1995 |
| JP | A 8-137311 | | 5/1996 |
| JP | 07152277 | A * | 6/1996 |
| JP | 08152798 | A * | 6/1996 |
| JP | A 10-64670 | | 3/1998 |
| JP | A 10-198202 | | 7/1998 |
| JP | A 2000-214702 | | 8/2000 |
| JP | 2000356919 | A * | 12/2000 |
| JP | 2001043966 | A * | 2/2001 |
| JP | A 2001-66920 | | 3/2001 |
| JP | 2001228740 | A * | 8/2001 |
| JP | A 2001-312168 | | 11/2001 |
| JP | A 2002-8845 | | 1/2002 |
| JP | A 2002-72755 | | 3/2002 |

* cited by examiner

*Primary Examiner*—Robert Beatty
(74) *Attorney, Agent, or Firm*—Oliff & Berridge, PLC

(57) ABSTRACT

A fixing device includes a heating roller, electromagnetic induction heater for heating the heating roller, and a pressurization roller disposed in contact with the outer periphery of the heating roller. The electromagnetic induction heater has a support extending like a tube along the outer periphery of the heating roller containing both ends in an axial direction orthogonal to a rotational direction of the heating roller and both sides parallel with the axial direction outside the heating roller. A coil is wound around the outer face of the support so as to contain a center axis of the heating roller inside the tubular part. The fixing device nips and transports recording paper to which toner has been transferred in a press contact nip part between the heating roller and the pressurization roller so as to fix an image.

25 Claims, 11 Drawing Sheets

FIXING DEVICE AND IMAGE FORMING APPARATUS INCLUDING A TUBULAR COIL WINDING

BACKGROUND OF THE INVENTION

1. Field of the Invention

This invention relates to a fixing device for fixing a developer transferred onto a recording material and an image forming apparatus.

2. Description of the Related Art

In an image forming apparatus such as a laser printer, a general fixing device for fixing a developer transferred onto a recording material includes a cylindrical heating roller and a pressurization roller for coming in contact with the heating roller in parallel. The fixing device allows a recording material such as recording paper to pass through a nip between the heating roller and the pressurization roller and fixes the unfixed developer such as toner transferred to the recording material by heat of the heating roller (for example, heated to a temperature of about 150° C.).

A halogen lamp or an electromagnetic induction heater is used as a source for heating the heating roller.

In a fixing device having a halogen lamp as a source for heating a heating roller, the halogen lamp is placed in a hollow heating roller and an electric current flows into the halogen lamp to thereby radiate infrared rays from the halogen lamp to the inner wall of the heating roller and are converted into heat. The heat is then transmitted to the surface of the heating roller. This configuration requires a supporting device for placing the halogen lamp in the heating roller and connection parts to an electric circuit, and the portions out of contact with paper such as the supporting device and the connection parts are also warmed uniformly. Thus, the amount of heat diffused uselessly into the atmosphere is large and energy is much wasted, prolonging a warming-up time period since a time when an electric current is applied to the halogen lamp till a time when the heating roller reaches a developer fixing temperature (about 150° C.).

On the other hand, a fixing device having an electromagnetic induction heater as a source for heating a heating roller is available to shorten the warning-up time.

JP-A-2002-072755 (p. 4–5, FIG. 1) discloses a fixing device having an electromagnetic induction heater as a heating source. The electromagnetic induction heater is placed on the opposite side to a contact part of the heating roller with a recording material. In the electromagnetic induction heater, a coil shaped like a spiral so as to extend in the roller axial direction and made flat (flat coil) is bent and placed so as to cover like a circular arc with a constant gap maintained along the roughly semi-circumferential face of the heating roller. When an alternating current is supplied to the coil, an AC magnetic field is applied to the heating roller for heating.

However, according to the fixing device disclosed in JP-A-2002-072755, the coil is disposed so as to cover via the gap along the roughly semi-circumferential face of the heating roller. If the gap varies, the heating efficiency of the electromagnetic induction heater changes and the surface temperature of the heating roller easily varies.

Since the coil is disposed so as to be opposed directly to the heating roller via the gap, the radiant heat from the heated heating roller to the outside is transferred directly to the coil. When the coil is heated and electric resistance thereof increases, the heating efficiency of the electromagnetic induction heater is decreased.

JP-A-58-035568 (p. 2–3, FIGS. 1–3) discloses a fixing device having an electromagnetic induction heater as a heating source including a heating roller formed with a high-heat electric conductive thin layer on the surface formed like a hollow cylinder, a frame-like core made of a magnetic-permeability material, and a coil wound around one side of the frame-like core. The one side of the core around which the coil is wound is disposed with a gap between the side and the outer peripheral surface of the heating roller along the axial direction of the heating roller, and an opposite side opposed to the one side of the core is made to pierce the inside of the heating roller. An alternating current is allowed to flow into the coil to thereby introduce a magnetic flux into the opposite side of the core piercing the inside of the heating roller and the magnetic flux in the heating roller causes an eddy current to be generated on the surface of the heating roller, heating the high-heat conductive thin layer on the surface of the heating roller. Drive means of the fixing device is configured such that an end part of a pressurization roller is fixed to a sprocket connected to a rotation shaft of a motor by a chain. The rotation force of the motor is transferred to the pressurization roller and the outer peripheral surface of the heating roller and the outer peripheral surface of the pressurization roller are brought into contact with each other, so that the rotation force of the pressurization roller is transferred to the heating roller. JP-A-2002-008845 (p. 5–6, FIGS. 1–2) discloses a fixing device having an electromagnetic induction heater as a heating source including a tubular belt guide, an electromagnetic inductive belt fitted loosely onto the surface of the belt guide for rotation, and a magnetic core and a magnetic coil which are stored in the belt guide. An alternating current is applied to the coil to thereby introduce an alternating magnetic flux into the magnetic core and causes an eddy current to be generated on the electromagnetic inductive belt, heating the electromagnetic inductive belt. A rotation shaft of a pressurization roller is projected from a side wall of a chassis covering the surroundings of the electromagnetic induction heater, a heating roller and the pressurization roller. The shaft is joined to drive means outside the chassis through a gear, the pressurization roller is rotated, and a fixing belt is turned by the frictional force of the outer faces of the pressurization roller and the fixing belt.

Improvement of heating efficiency and miniaturization, space saving, etc., are required for the fixing device, and the drive means of the fixing device having high drive accuracy without impairing the heating efficiency is required.

However, according to the fixing device disclosed in JP-A-58-035568, an alternating current flows into the coil disposed outside the heating roller to introduce a magnetic flux into the core (one side of the core shaped like a frame) in the heating roller and the magnetic flux flowing into the core in the heating roller heats the surface of the heating roller. Thus, as compared with a fixing device for directly heating the surface of a heating roller by a magnetic flux of a coil disposed along the axial direction of the heating roller, the magnetic flux covering the surface of the heating roller is smaller and the heating efficiency on the surface of the heating roller is lower. When the number of windings of the coil is increased to provide a predetermined heating amount on the surface of the heating roller, the length of the coil in the axial direction thereof grows and it becomes difficult to save space in the length direction.

Since the coil is disposed so as to be opposed directly to the heating roller via the gap, the radiant heat from the heated heating roller to the outside is transferred directly to the coil. When the coil is heated and electric resistance increases, the heating efficiency of the electromagnetic induction heater is decreased.

According to the fixing device disclosed in JP-A-2002-008845, since the coil is stored in the tubular belt guide, it is difficult to radiate heat transferred from the electromagnetic inductive belt to the coil or heat from self-heating of the coil, etc. When the coil is heated and electric resistance is increased, the heating efficiency is decreased, and the temperature on the surface of the electromagnetic inductive belt varies.

JP-A-2000-214702 (p. 3–4, FIG. 1) discloses a fixing device having an electromagnetic induction heater as a heating source. The electromagnetic induction heater is placed on the opposite side to a contact part of a heating roller with a recording material. The electromagnetic induction heater has a coil wound around a magnetic substance core along the length direction of the heating roller, and gives an AC magnetic field to the coil, thereby heating the heating roller.

The heating roller includes an iron-made core metal cylinder as a core material, a heat insulating layer covering the outer periphery of the core material, and an electromagnetic induction heat generation layer covering the outer periphery of the heat insulating layer and formed by conducting an electroforming work on a metal such as nickel.

However, according to the fixing device disclosed in JP-A-2000-214702, the electromagnetic induction heat generation layer of the heating roller is formed by electroforming work and thus the manufacturing cost is increased and productivity is impaired. Since the iron-made core metal cylinder is included as a support, the core metal cylinder receives the AC magnetic field of a coil and generates heat and there is a possibility of impairing the heating efficiency heating the heating roller surface.

SUMMARY OF THE INVENTION

The present invention has been made to solve the above problems, and therefore one object of the present invention is to provide a fixing device including an electromagnetic induction heater for heating a heating body, in which temperature variations of the heating body can be decreased and the amount of thermal radiation that a coil receives from the heating body can be decreased and stable heating efficiency can be provided even when the relative positions of the coil and the heating body vary.

Another object of the invention is to provide a fixing device including an electromagnetic induction heater for heating a heating body, in which the heating efficiency of heating the heating body is excellent, the amount of thermal radiation that a coil receives from the heating body can be decreased, stable heating efficiency can be provided, and which is excellent in miniaturization and space saving.

Still another object of the invention is to provide a fixing device including an electromagnetic induction heater for heating a heating roller, in which an electromagnetic induction heat generation layer can be easily formed on a surface of the heating roller or on an outer layer in the proximity of the surface, the heat capacity for heating the surface of the heating roller to a fixing temperature is small, a fixing-possible temperature can be obtained promptly on the surface of the heating roller when the electromagnetic induction heater is activated, and heating efficiency is excellent.

According to one aspect of the invention, there is provided a fixing device including: a heating body that rotates; and an electromagnetic induction heater including a coil wound like a tube via a gap along an outer periphery of the heating body containing both ends in an axial direction orthogonal to a rotational direction of the heating body and both sides parallel with the axial direction so as to form a tubular part, wherein at least a part of the heating body is positioned inside the tubular part of the coil.

According to the fixing device thus configured, at least a part of the heating body is positioned inside the tubular part of the coil and thus if the relative positions of the coil and the heating body vary, change in the heating efficiency of heating the heating body is small and temperature variations of the heating body can also be decreased. That is, both sides and both ends of the heating body are in the coil of the tubular part and thus if one of both sides of the heating body is brought away from the coil, the other side is brought close to the coil and if one of both ends of the heating body is brought away from the coil, the other end is brought close to the coil, making it possible to decrease change in the heating efficiency of heating the heating body.

According to another aspect of the invention, there is provided a fixing device including: a heating body that rotates; a pressurization roller that rotates in association with the heating body, the pressurization roller and the heating body nipping and transporting a recording material to fix an unfixed developer onto the recording material; an electromagnetic induction heater including a coil wound like a tube via a gap along an outer periphery of the heating body containing both ends in an axial direction orthogonal to a rotational direction of the heating body and both sides parallel with the axial direction so as to form a tubular part, at least a part of the heating body being positioned inside the tubular part of the coil; and a driving device including a drive source having a rotation shaft outside the coil, the driving device transferring a drive force from the drive source via rotation transfer section to the heating body and the pressurization roller.

According to the fixing device thus configured, at least a part of the heating body is positioned inside the tubular part of the coil and thus if the relative positions of the coil and the heating body vary, a change in the heating efficiency of heating the heating body is small and temperature variations of the heating body can be decreased. That is, both sides and both ends of the heating body are in the coil of the tubular part and thus if one of both sides of the heating body is brought away from the pressurization roller, the other side is brought close to the coil and if one of both ends of the heating body is brought away from the pressurization roller, the other end is brought close to the pressurization roller, making it possible to decrease change in the heating efficiency of heating the heating body.

Since the coil is disposed along the outer periphery of the heating body, the heat radiation effect of the coil is high and degradation of the heating efficiency caused by a temperature rise of the coil can be suppressed, providing stable heating efficiency.

The fixing device has the drive source having the rotation shaft outside the coil, and the driving device is configured so as to transfer the drive force from the drive source via the rotation transfer member to the heating body and the pressurization roller, so that the coil can be wound in a small diameter via the gap along the outer periphery of the heating body without being limited by the space in which the driving device is placed, and miniaturization and space saving are made possible.

According to still another aspect of the invention, there is provided a fixing device including: a heating roller having a cylindrical support part and magnetic metal foil of a strip wound around an outer peripheral surface of the cylindrical support part; a pressurization roller pressed against the heating roller; and an electromagnetic induction heater that externally heats the heating roller.

According to the fixing device thus configured, magnetic metal foil of a strip is wound around the surface of the cylindrical support part of the heating roller in a spiral fashion, so that an electromagnetic induction heat generation layer can be easily formed. Since the magnetic metal foil can be used to form the electromagnetic induction heat generation layer as a thin film, the heat capacity of the electromagnetic induction heat generation layer can be lessened. When the electromagnetic induction heater is activated, the surface of the heating roller reaches a fixing-possible temperature promptly and a fixing device excellent in heating efficiency can be provided.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS (First Embodiment)

A first embodiment of the invention will be discribed with reference to the accompanying drawings.

Figure 1:
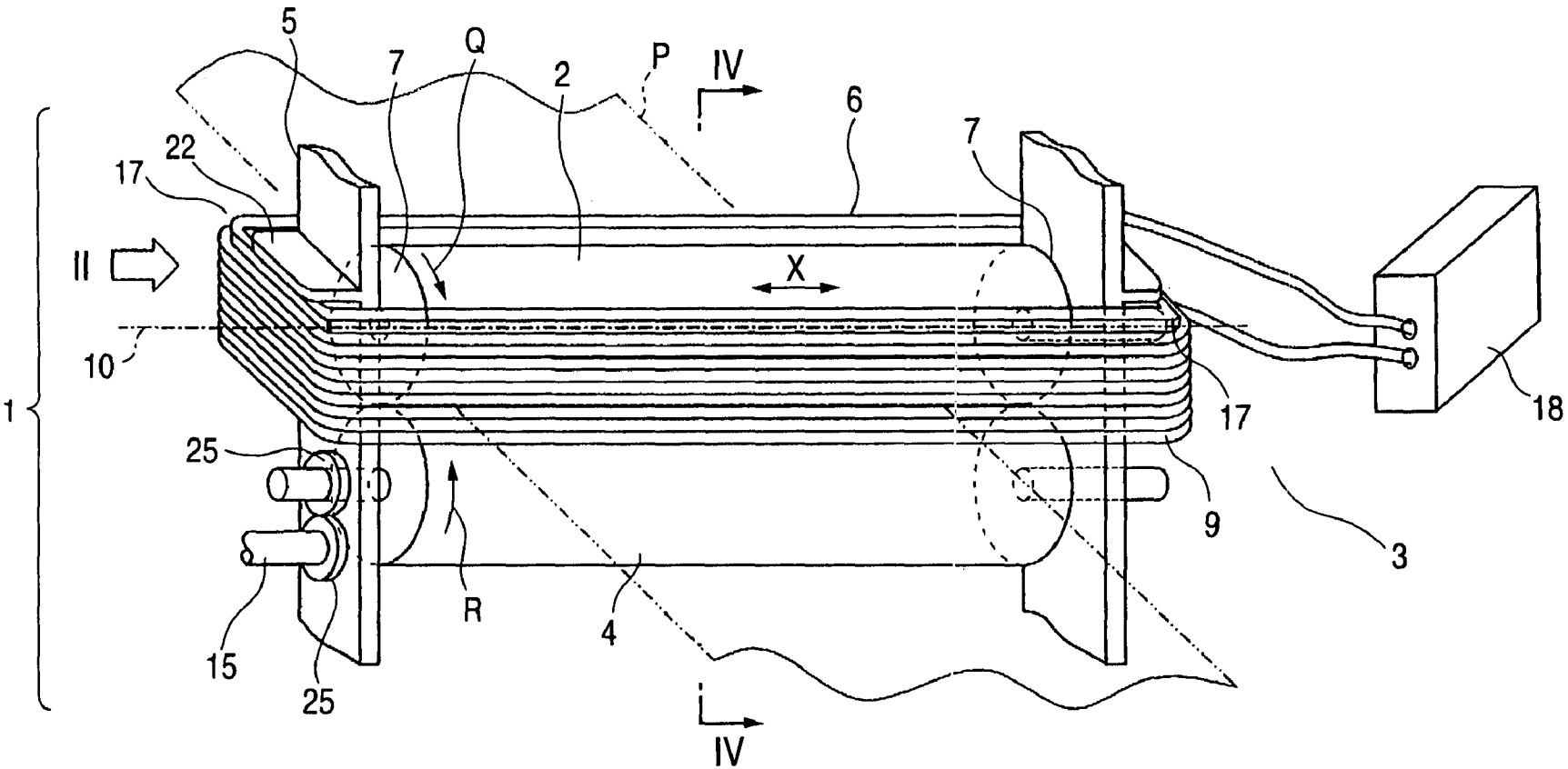
FIG. 1 is an external perspective view showing a configuration of a fixing device according to a first embodiment of the invention.
Figure 2:
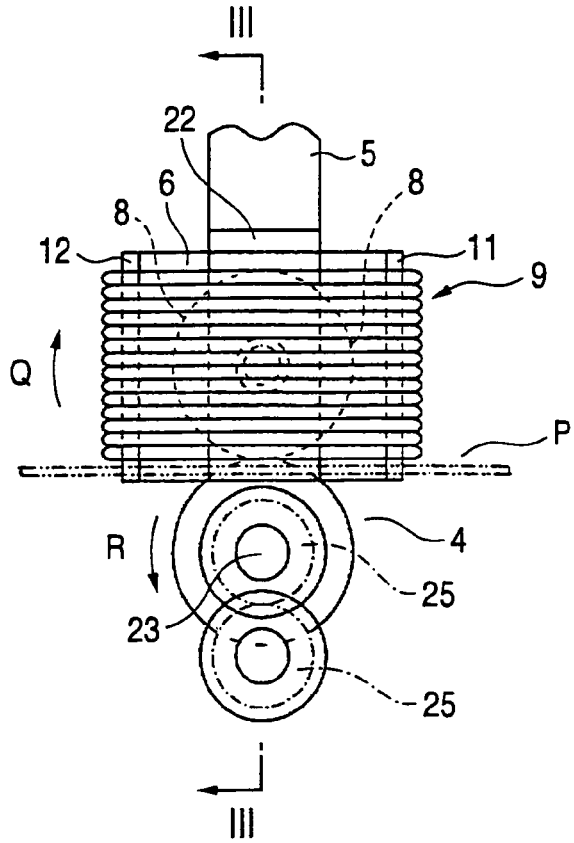
FIG. 2 is an arrow II view in FIG. 1.
Figure 3:
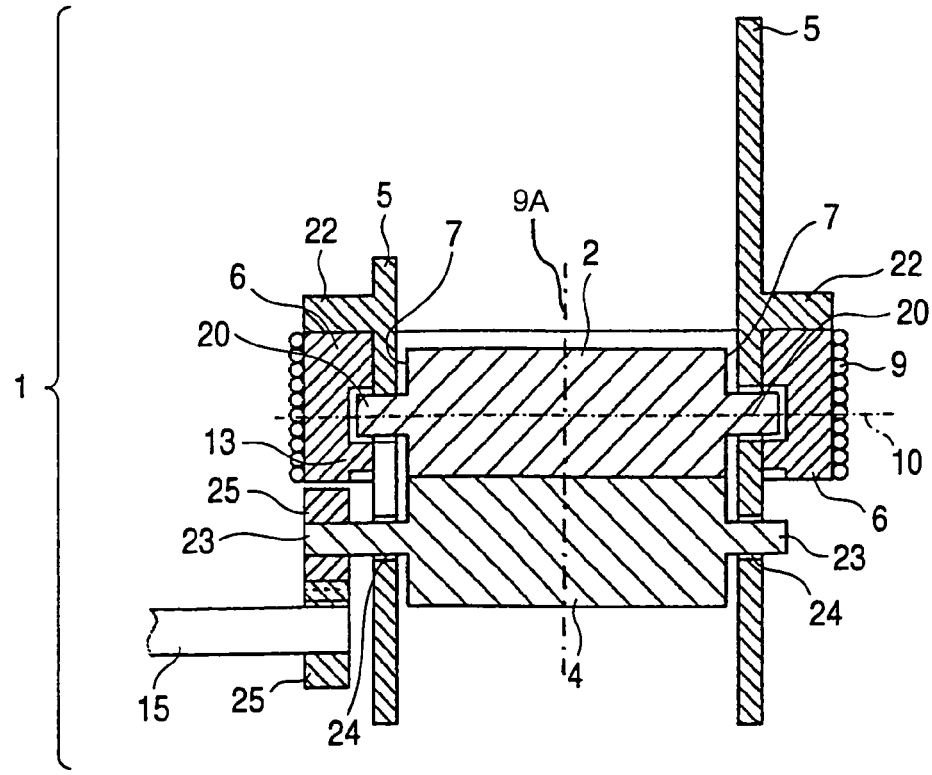
FIG. 3 is a sectional view taken along line III—III in FIG. 2.
Figure 4:
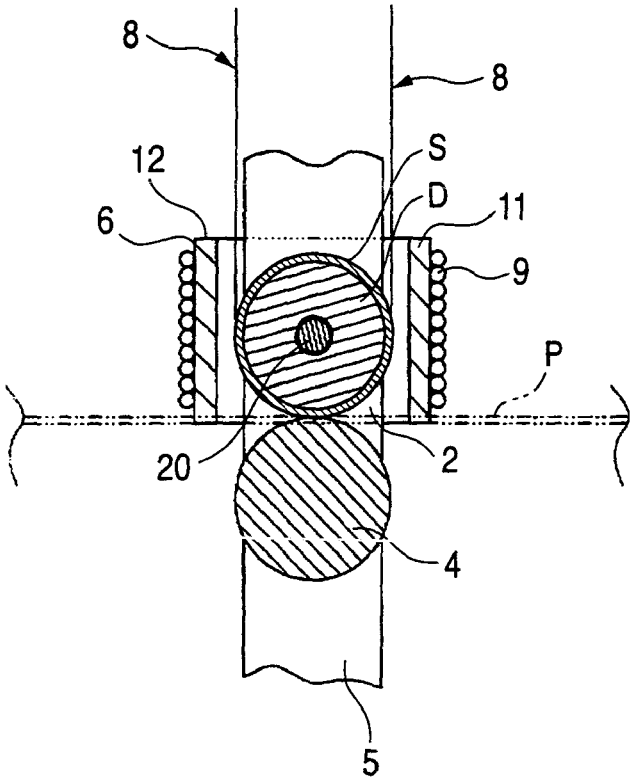
FIG. 4 is a sectional view taken along line IV–IV in FIG. 1.

FIG. 1 is an external perspective view showing a configuration of a fixing device of the first embodiment, FIG. 2 is an arrow II view in FIG. 1, and FIG. 3 is a sectional view taken along line III—III in FIG. 2. FIG. 4 is a sectional view taken along line IV—IV in FIG. 1.

In FIGS. 1 to 4, a fixing device 1 includes a heating roller 2 that rotates in a circumferential direction of the roller as a heating body, an electromagnetic induction heater 3 for heating the heating roller 2, a pressurization roller 4 being disposed in parallel with the heating roller 2 and being in contact with the outer periphery of the heating roller 2 for nipping and transporting recording paper P (corresponding to a recording material) with the heating roller 2, and supporting devices 5 for supporting the fixing device 1 to a predetermined position of a machine. The fixing device 1 nips and transports recording paper P to which a developer such as toner has been transferred in a press contact nip part between the heating roller 2 and the pressurization roller 4 and fixes the unfixed developer onto the recording paper P.

The electromagnetic induction heater 3 includes a support 6 extending like a tube along the outer periphery of the heating roller 2 containing both ends 7 in an axial direction X orthogonal to a rotation direction Q of the heating roller 2 and both sides 8 parallel with the axial direction, a coil 9 wound around a winding axis 9A (shown in FIG. 3) and an outer face of the support 6 50 as to contain a center axis 10 of the heating roller 2 inside a tubular part thereof, and an exciting circuit section 18 for applying an AC current to the coil 9. The winding axis is substantially perpendicular to the center axis 10 of the heating roller 2.

The heating roller 2 has a surface covered with magnetic metal S such as carbon steel, nickel, or stainless steel for the electromagnetic induction heater 3 to heat the heating roller 2. An electric current is allowed to flow into the coil 9 placed on the outer periphery of the heating roller 2, so that an eddy current flows along the surface of the heating roller 2 and is converted into heat for heating the heating roller 2. The inside of the heating roller 2 is formed of a resin layer D having heat insulating properties, nonmagnetism, nonconductivity, heat resistance, etc., so that the surface of the heating roller 2 can be heated efficiently. The resin layer D has elasticity so that recording paper P can be easily stripped from the heating roller 2.

A rotation shaft 20 is formed integrally with the heating roller 2 so as to project from the both ends 7 and is supported on each bearing 13 formed on the support 6 for rotation.

Recording paper P (corresponding to a recording material) is nipped between the outer peripheral surface of the heating roller 2 and the outer peripheral surface of the pressurization roller 4. As the heating roller 2 and the pressurization roller 4 rotate, the recording paper P is transported in the rotation direction.

To enhance the heating efficiency of the electromagnetic induction heater 3, the support 6 is made of a heat-resistant resin having heat insulating properties, nonmagnetism, nonconductivity, etc.

The support 6 includes side walls 11 and 12. The support 6 extends like a tube along the outer periphery of the heating roller 2 containing both ends 7 in the axial direction orthogonal to the rotation direction Q of the heating roller 2 and both sides 8 parallel with the axial direction. The side walls 11 of the support 6 shaped like a tube are formed in parallel along both sides 8 of the heating roller 2. The coil 9 (described later) is wound like a tube along the outer peripheral surfaces of the side walls 11 and 12 as shown in FIGS. 2 and 4.

To support the heating roller 2 for rotation and maintain the relative positions of the heating roller 2 and the pressurization roller 4 with high accuracy, the support 6 is equipped with the bearing 13 for supporting the rotation shaft 20 of the heating roller 2. The rotation shaft 20 of the heating roller 2 is inserted into the bearing 13 as shown in FIG. 3.

The support 6 has four corners 17 of the tubular part positioned on the sides of both ends 7 of the heating roller 2. Each of the four corners is formed in a curved shape so that a portion of the coil 9 extending from an end in the axial direction orthogonal to the rotation direction of the heating roller 2 to a sides parallel with the axial direction can be formed in a curved shape.

That is, the coil is wound like a curve so that an edge does not occur in the coil wire. Thus, the coil wire can be prevented from being cracked and excellent reliability can be provided.

To suppress an increase in the resistance value of the coil 9, the coil 9 is formed using litz wire made up of a plurality of conductors each covered with an insulating film of enamel, etc. As compared with a single wire, litz wire can increase the surface area and can suppress an increase in winding resistance caused by the skin effect, so that high heating efficiency can be provided.

That is, as a high-frequency current flows into the coil, the current easily concentrates on the coil surface because of the skin effect and the resistance value increases. Thus, by using the litz wire, the surface area of the coil can be increased for suppressing an increase in the resistance value of the coil.

The coil 9 is, as described above, wound like a tube along the outer peripheral surface of the tubular support 6 and respective corresponding portions from both ends 7 in the axial direction orthogonal to the rotation direction of the heating roller 2 to both sides 8 parallel with the axial direction is wound in a curved shape.

Since the outer peripheral surfaces of both side walls 11 and 12 of the support 6 around which the coil 9 is wound are formed in parallel with each other, the coil 9 is formed like a tube with side walls opposed to each other in parallel along both sides 8 of the heating roller 2.

To enhance the heating efficiency of the electromagnetic induction heater 3, the supporting devices 5 are made of a resin having heat insulating properties, nonmagnetism, nonconductivity, heat resistance, etc.

The supporting devices 5 are placed on the sides of both ends 7 of the heating roller 2 in the axial direction thereof and inside the support 6. Each supporting device includes a joint part 22 for joining to the support 6 and a bearing part 24 for supporting a rotation shaft 23 of the pressurization roller 4 (described later). The extension tip of the supporting device 5 is fixed to a cabinet (not shown) and the fixing device 1 is installed at a predetermined position of a machine such as an image forming apparatus via the supporting device 5.

To enhance the heating efficiency of the electromagnetic induction heater 3, the pressurization roller 4 is made of a resin having heat insulating properties, nonmagnetism, nonconductivity, heat resistance, etc.

The pressurization roller 4 is disposed so as to come in contact with the heating roller 2 along the outer peripheral surface of the cylindrical shape of the heating roller 2 and the rotation shafts 23 formed at both ends thereof is supported on the bearing parts 24 formed in the supporting devices 5 for rotation. Recording paper P can be nipped and transported between the outer peripheral surfaces of the pressurization roller 4 and the heating roller 2.

One of the rotation shafts 23 of the pressurization roller 4 is supported on the bearing part 24 of the supporting device 5 and projects from the outer face of the supporting device 5 and is connected to a rotation shaft 15 of a drive motor (not shown) through a gear 25. Accordingly, a rotation force in an R direction is transmitted from the drive motor to the pressurization roller 4 and the outer peripheral surfaces of the pressurization roller 4 and the heating roller 2 come in contact with each other, so that the heating roller 2 rotates in conjunction in a Q direction.

Now, the advantages of the fixing device according to the first embodiment will be described.

According to the fixing device of the first embodiment, both ends 7 of the heating roller 2 in the axial direction thereof and both sides 8 parallel with the axial direction thereof are placed in the tubular part of the coil 9. Thus, even when the relative positions of the roil 9 and the heating roller 2 vary, a change in the heating efficiency of the heating roller 2 is small and temperature variations on the surface of the heating roller 2 can be decreased.

Since the heating roller 2 is placed with its center axis being contained inside the tubular part of the coil 9, temperature variations of the heating roller 2 can be further decreased and the heating roller 2 can be heated more efficiently.

According to the fixing device of the first embodiment, the coil 9 is wound around the support like a tube opposed to and in parallel with the heating roller 2 along both sides 8 of the heating roller 2. Thus, the amount of thermal radiation that the coil 9 receives from the heating roller 2 can be decreased and the electric resistance of the coil 9 becomes stable without increasing, so that the fixing device 1 that achieves high heating efficiency can be provided.

That is, in the tubular part of the coil, the side walls opposed to each other along both sides of the heating roller are parallel and the heating roller is shaped like a cylinder, so that the distance between the outer peripheral surface of the heating roller and the coil becomes the shortest at the position at which the axis orthogonal to the center axis of the heating roller is orthogonal to the side wall of the tubular part, and from this position, the distance between the outer peripheral surface of the heating roller and the coil gradually increases along the circumferential direction of the heating roller, so that the amount of thermal radiation that the coil receives from the heating roller can be decreased.

The fixing device of the first embodiment has the support 6 extending like a tube along the outer periphery of the heating roller 2 containing both ends 7 of the heating roller 2 in the axial direction thereof and both sides 8 parallel with the axial direction. At least a part of the heating roller 2 is positioned inside the support 6, and the coil 9 is wound around the outer peripheral surface of the support 6, so that the coil 9 can be easily wound, the position accuracy of the coil 9 and the heating roller 2 can be enhanced, and the fixing device 1 with small temperature variations on the surface of the heating roller 2 and having excellent heating efficiency can be provided.

Since the support 6, the supporting devices 5, etc., disposed outside the heating roller 2 are made of resins having heat insulating properties, nonmagnetism, nonconductivity, heat resistance, etc., even when the heating roller 2 is heated to a high temperature, a temperature rise of the coil 9 can be prevented, an increase in the electric resistance of the coil 9 can be suppressed, and the support 6 and the supporting devices 5 do not generate heat. Thus, the fixing device 1 excellent in heating efficiency can be provided.

(Second Embodiment)

Subsequently, a second embedment of a fixing device of the invention will be described with reference to FIG. 6.

Figure 6:
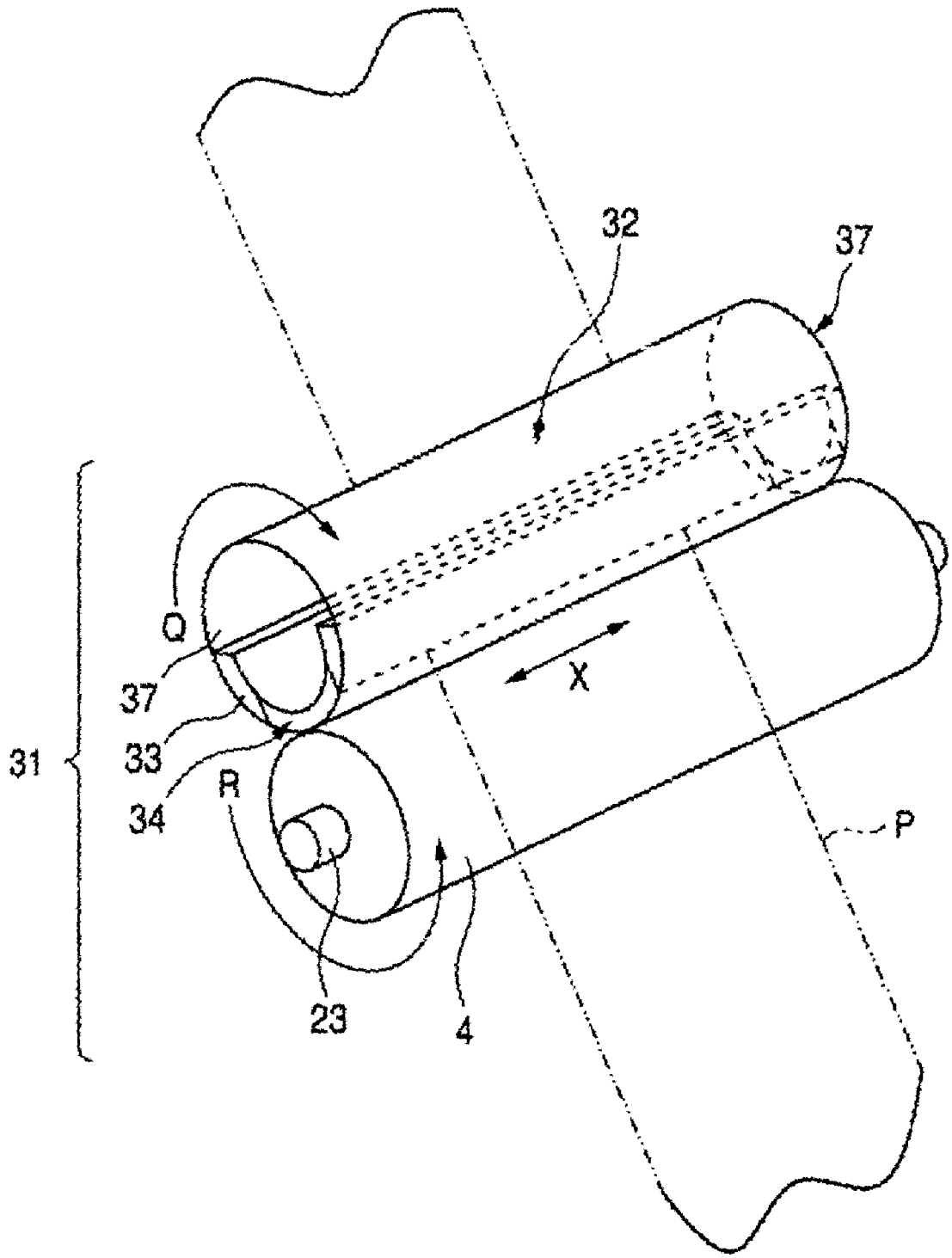
FIG. 6 is an external perspective view showing a configuration of a fixing device according to a second embodiment of the invention.

FIG. 6 is an external perspective view showing a configuration of a fixing device of the second embodiment.

A fixing device 31 in the second embodiment basically has the same configuration as the fixing device 1 of the first embodiment and therefore components common to the fixing device 1 are not shown and will not be discussed again in detail and only features will be discussed.

The fixing device 31 includes a guide body 33 shaped roughly like a semicylinder, a heating body 32 implemented as a tubular film disposed slidably along the outer peripheral surface of the guide body 33, a pressurization roller 4 being disposed in parallel with the heating body 32 and being in contact with the outer peripheral surface of the heating body 32 for nipping and transporting recording paper P (corresponding to a recording material) with the heating body 32, an electromagnetic induction heater (not shown) for heating the heating body 32, and supporting devices (not shown) for supporting the fixing device 31 to a predetermined position of a machine.

The fixing device 31 nips and transports the recording paper P to which a developer such as toner has been transferred in a press contact nip part between the heating body 32 and the pressurization roller 4 and fixes the developer such as unfixed toner onto the recording paper P.

The heating body 32 is formed of a thin metal film having conductivity and magnetism (for example, a film of carbon steel, nickel, stainless steel, etc., having 50 μm thick) for the electromagnetic induction heater (not shown) to heat the heating body 32.

The heating body 32 covers the guide body 33 slidably along the outer peripheral surface of the guide body 33 shaped roughly like a semicylinder.

The heating body 32 is disposed so that the outer peripheral surface along an axial direction X comes in contact with the pressurization roller 4. Rotation of the pressurization roller 4 is transferred to the heating body 32, which then is rotated (in a Q direction in FIG. 6) along the outer peripheral surface of the guide body 33.

One of rotation shafts 23 of the pressurization roller 4 is connected to a rotation shaft of a drive motor (not shown) through a gear as in the first embodiment. Accordingly, a rotation force in an R direction is transmitted from the drive motor to the pressurization roller 4, the outer peripheral surface of the pressurization roller 4 and the outer peripheral surface of the heating body 32 come in contact with each other, and the rotation force for a circular move (in the Q direction in FIG. 6) is transferred to the heating body 32.

To enhance the heating efficiency of the electromagnetic induction heater, the guide body 33 is made of a resin having heat insulating properties, nonmagnetism, nonconductivity, heat resistance, etc.

The guide body 33 is formed with a nip part 34 having a smooth face for nipping recording paper P with the pressurization roller 4 via film. The heating body 32 can slide smoothly on the nip part.

Outside the heating body 32, the electromagnetic induction heater having a coil 9 wound like a tube via a gap along the outer periphery of the heating body 32 containing both ends 37 of the heating body 32 in the axial direction orthogonal to the rotational direction of the heating body 32 and both sides parallel with the axial direction is provided as in the first embodiment. More than half of the circumferential face of the heating body 32 (heating area) is positioned in the tubular part of the coil 9.

Now the advantages of the fixing device according to the second embodiment will be described.

Since the fixing device of the second embodiment has the heating body 32 implemented as a film, the heat capacity to raise the heating body 32 to the fixing temperature can be decreased. When the electromagnetic induction heater is activated, the fixing temperature can be obtained promptly and temperature variations of the heating body 32 can be decreased and efficient heating can be accomplished.

(Third Embodiment)

Figure 7:
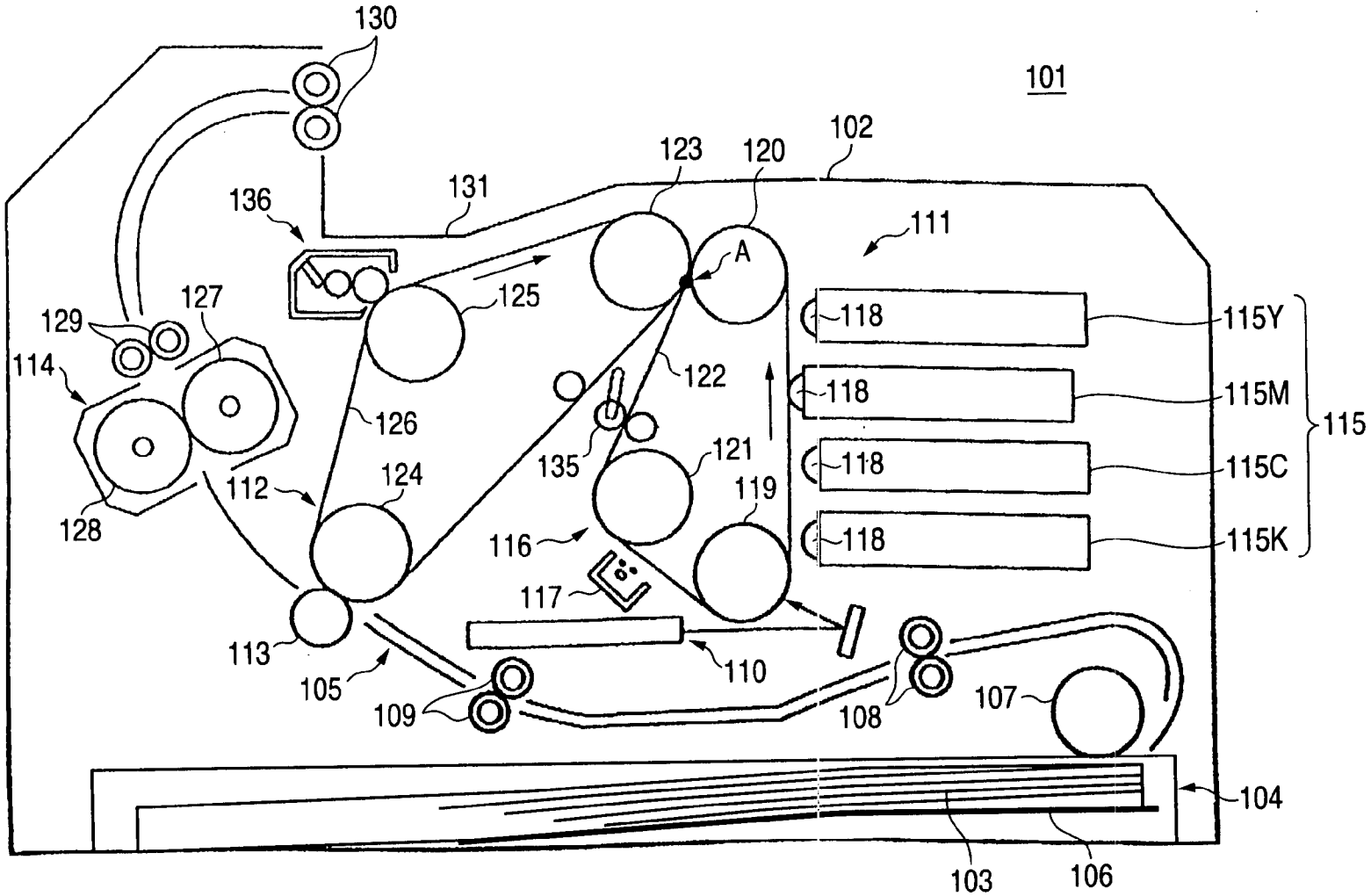
FIG. 7 is an external perspective view showing a configuration of an image forming apparatus according to a third embodiment of the invention.

Subsequently, an image forming apparatus using a fixing device of the invention will be described with reference to FIG. 7. FIG. 7 is a drawing to show a general configuration of an image forming apparatus using a fixing device of a third embodiment of the invention.

FIG. 7 is a drawing to schematically show a mechanical configuration of a color laser printer 101 as the image forming apparatus of the third embodiment of the invention.

In FIG. 7, the color laser printer 101 includes a paper feeder 104 for feeding recording paper 103 as a recording medium, an image formation section 105 for forming a predetermined image on the fed recording paper 103, and other members in a main unit casing 102.

The recording paper 103 is stacked on a paper feed tray 106 in the paper feeder 104. The paper 103 on the top of the paper feed tray 106 is fed one sheet at a time with rotation of a paper feed roller 107, and is transported to the image formation section 105 by means of a transport roller 108 and a registration roller 109.

The image formation section 105 includes a scanner unit 110 for scanning laser light over the surface of a photosensitive belt 122 (described later) based on predetermined image data and forming a latent image, a process unit 111 for transferring a developer such as toner to the photosensitive belt 122, an intermediate transfer belt mechanism 112, a transfer roller 113, a fixing device 114, etc.

The scanner unit 110 functions as latent image formation unit and includes a laser light emitter, a polygon mirror, a plurality of mirrors, and a reflecting mirror (not shown). In the scanner unit 110, a laser beam emitted from the laser light emitter based on predetermined image data is passed through or reflected through the reflecting mirror and the lenses and is scanned at high speed over the surface of the photosensitive belt 122 of a photosensitive belt mechanism 116 (described later).

The process unit 111 includes a developing cartridge unit 115, the photosensitive belt mechanism 116, and a scorotron charger 117, etc.

In the embodiment, the developing cartridge unit 115 includes four cartridges of a yellow developing cartridge 115Y for supplying yellow toner, a magenta developing cartridge 115M for supplying magenta toner, a cyan developing cartridge 115C for supplying cyan toner, and a black developing cartridge 115K for supplying black toner.

Toner storage portions of the developing cartridge unit 115 store toners of positive charge property as color developers of yellow, magenta, yellow, and black. When toner is supplied to a developing roller 118 as a supply roller (not shown) rotates, the toner is carried on the developing roller 118 as a thin layer of a given thickness by a layer thickness regulation blade (not shown). In this situation, the toner is positively charged and is carried on the developing roller 118 by electrostatic power.

The photosensitive belt mechanism 116 has a first photosensitive belt roller 119, a second photosensitive belt roller 120, and a third photosensitive belt roller 121 placed along a triangular shape on which the photosensitive belt 122 is wound.

The photosensitive belt 122 is made of a resin such as PET (polyethylene terephthalate) with aluminum evaporated onto the surface, and has an organic photosensitive layer on the surface.

As the second photosensitive belt roller 120 rotates by a drive source (not shown), the photosensitive belt 122 makes an orbital move (makes an orbital move counterclockwise in FIG. 7). As the photosensitive belt 122 makes an orbital move, a latent image of positive charge property is formed on the photosensitive belt 122 as image data by the scanner unit 110 and then the photosensitive belt 122 abuts the developing roller 118 carrying toner of positive charge property and the toner is transferred to the photosensitive belt 122, forming an electrostatic image.

As the second photosensitive belt roller 120 rotates, the first photosensitive belt roller 119 and the third photosensitive belt roller 121 are driven, and the photosensitive belt 122 makes an orbital move.

The intermediate transfer belt mechanism section 112 is placed adjacent to the photosensitive belt mechanism 116 and includes a first intermediate transfer belt roller 123 opposed to the second photosensitive belt roller 120 via the photosensitive belt 122 and an intermediate transfer belt 126, a second intermediate transfer belt roller 124 opposed to the transfer roller 113 (described later) via the intermediate transfer belt 126, a third intermediate transfer belt roller 125 placed like a triangular shape together with the first intermediate transfer belt roller 123 and the second intermediate transfer belt roller 124, and the intermediate transfer belt 126 wound on the first intermediate transfer belt roller 123, the second intermediate transfer belt roller 124, and the third intermediate transfer belt roller 125.

The intermediate transfer belt 126 is made of a heat-resistant resin with conductive particles of carbon, etc., dispersed, and makes an orbital move (makes an orbital move clockwise in FIG. 7) while coming in contact with the photosensitive belt 122 at a transfer position A. The toner image formed on the photosensitive belt 122 is transferred to the intermediate transfer belt 126. In the embodiment, four color toners are provided and thus the photosensitive belt 122 further is orbited and is cleaned by a cleaning roller 135 connected to a static eliminator and again is charged by the charger 117. Subsequently, an electrostatic image of another color is formed and is developed by the corresponding color toner and the developed image is superposed on the toner image previously transferred to the intermediate transfer belt 126. This is repeated for four colors to thereby transfer a four-color image onto the intermediate transfer belt 126.

The transfer roller 113 is placed movably at a position opposed to the second intermediate transfer belt roller 124 via the intermediate transfer belt 126. The transfer roller 113 comes in and out of contact with the surface of the intermediate transfer belt 126. When recording paper 103 is transported, the transfer roller 113 comes in contact with the surface of the intermediate transfer belt 126 and a predetermined transfer bias is applied. The four-color image formed on the intermediate transfer belt 126 is transferred at once to the recording paper 103 passing through the nip between the intermediate transfer belt 126 and the transfer roller 113.

Since the color image transferred onto the recording paper 103 is unfixed, the recording paper 103 is transported to the fixing device 114 (described later) for fixing the color image.

The fixing device 114 has a similar configuration to that of the fixing device 1 of the first embodiment or the fixing device 31 of the second embodiment. While the recording paper 103 passes through the nip between a heating roller 127 and a pressurization roller 128, the color image is fixed onto the recording paper 103.

The recording paper 103 with the color image fixed by the fixing device 114 is transported by a transport roller 129 to a paper discharge roller 130 and is discharged to a paper discharge tray 131.

The image forming apparatus of the third embodiment having the described configuration includes the fixing device 114 having the same configuration as the fixing device of the first embodiment or the second embodiment, so that an image can be uniformly fixed onto the recording paper 103 and an image having high reproducibility can be provided.

Although the invention has been described in its preferred embodiments, it is to be understood that the invention is not limited to the specific embodiments thereof and various modifications can be made.

Figure 5:
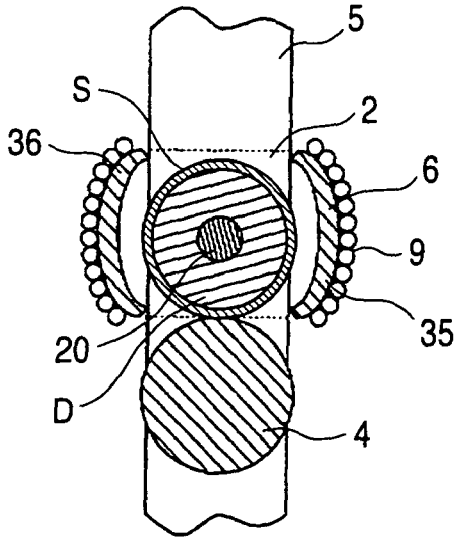
FIG. 5 is a sectional view showing a modified example of the fixing device shown in FIG. 4.

For example, according to the fixing device 1 of the first embodiment, the coil 9 is wound around the outer peripheral surface of the support 6 including both parallel side walls 11 and 12 and both side walls of the tubular coil 9 are formed in parallel along both sides in the axial direction of the heating roller 2 as shown in FIGS. 2 and 4, but the coil 9 may be wound around the outer peripheral surface of the support 6 including both side walls 35 and 36 bent along the heating roller 2, thereby disposing the coil 9 bent along both sides in the axial direction of the heating roller 2 as shown in FIG. 5.

The support 6 is formed so as to cover the heating roller 2 like a tube, but may be formed so as to further cover the pressurization roller 4.

Although the coil 9 is wound around the outer peripheral surface of the support 6, if the effect of radiant heat from the heating roller 2 is small, the coil 9 may be wound around the inner surface of the support 6.

The heating roller 2 is shaped like a cylinder having the outer peripheral surface parallel along the axial direction, but a diametric part of the cylindrical shape not in contact with the recording paper P may be formed so as to have a slightly large diameter and the heating roller 2 may be brought into contact with the pressurization roller 4 in the diametric part for transferring the rotation force from the pressurization roller 4 to the heating roller 2.

The coil 9 is formed using litz wire of a plurality of conductors for making the surface area large, thereby suppressing an increase in the resistance value caused by the skin effect, but a single wire formed with asperities on the surface may be used to make the surface area large.

According to the fixing device 31 of the second embodiment, the heating body 32 is made of a tubular film, but a molded thin pipe may be used.

According to the fixing device 31 of the second embodiment, the heating body 32 is formed of a thin metal film having magnetism (for example, a film of carbon steel, nickel, stainless steel, etc., 50 μm thick), but metal, a metal compound, an organic conductor, etc., having no magnetism may be used.

The image forming apparatus of the third embodiment forms a four-color image, but may be an image forming apparatus for forming a monochrome image.

The image forming apparatus of the third embodiment forms a color image on one surface of recording paper, but may fix a color image on the one surface and then may further reverse the recording paper and form a color image on the other surface.

The image forming apparatus of the third embodiment is equipped with a fixing device having a similar configuration to that of the fixing device of the first embodiment or the second embodiment, but may be equipped with a fixing device described below.

(Fourth Embodiment)

Subsequently, a fourth embedment of a fixing device of the invention will be described with reference to FIG. 8.

Figure 8:
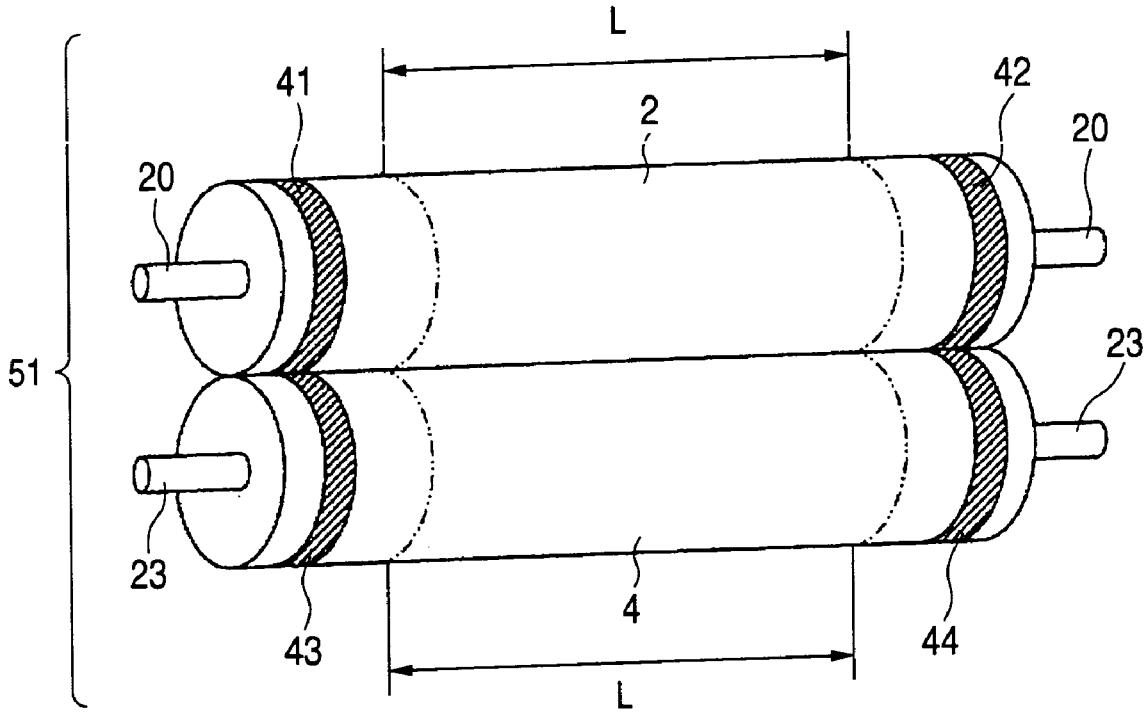
FIG. 8 is an external perspective view showing a rotation transfer part of a heating roller and a pressurization roller in a fourth embodiment of the invention.

FIG. 8 is a rotation transfer part of a heating roller and a pressurization roller of a fixing device of the fourth embodiment.

A fixing device 51 in the fourth embodiment basically has the same configuration as the fixing device 1 of the first embodiment and therefore components common to the fixing device 1 are not shown and will not be discussed again in detail and only features will be discussed.

The fixing device 51 includes a heating roller 2 for rotating in the circumferential direction of the roller diameter as a heating body, an electromagnetic induction heater 3 for heating the heating roller 2, a pressurization roller 4 being disposed in parallel with the heating roller 2 in contact with the outer periphery of the heating roller 2 for nipping and transporting recording paper P (corresponding to a recording material) with the heating roller 2, driving device for driving the heating roller 2 and the pressurization roller 4 (described later), and supporting devices 5 for supporting the fixing device 1 to a predetermined position of a machine. The fixing device 1 nips and transports recording paper P to which a developer such as toner has been transferred in a press contact nip part between the heating roller 2 and the pressurization roller 4 and fixes the unfixed developer onto the recording paper P.

To enhance the heating efficiency of the electromagnetic induction heater 3, the pressurization roller 4 is made of a resin having heat insulating properties, nonmagnetism, non-conductivity, heat resistance, etc.

The pressurization roller 4 is disposed so as to come in contact with the heating roller 2 along the outer peripheral surface of the cylindrical shape of the heating roller 2 and the rotation shafts 23 formed at both ends is supported on the bearing parts 24 formed in the supporting devices 5 for rotation. Recording paper P can be nipped between the outer peripheral surfaces of the pressurization roller 4 and the heating roller 2 and can be transported in the rotation direction.

The heating roller 2 and the pressurization roller 4 are formed on the outer peripheral surfaces with image formation area portions (ranges of L in FIG. 8) for nipping recording paper P therebetween and non-image formation area portions 41 and 42 and 43 and 44 outside both sides of each image formation area portion, the area portions 41 to 44 not nipping recording paper P, as shown in FIG. 8. In the non-image formation area portions 41 to 44, the outer diameter of the heating roller 2 is formed slightly larger than the outer diameter of the image formation area portion (range of L in FIG. 8) and each non-image formation area portion is formed on the surface with a non-slip portion in a large face roughness degree so as to increase a friction coefficient. In the non-image formation area portions 41 to 44, the heating roller 2 and the pressurization roller 4 are pressed against each other and the rotation force of the pressurization roller 4 is reliably transferred to the heating roller 2.

The non-image formation area portion have a larger outer diameter than that of the image formation area portion, so that the image formation area portion is not worn by transfer of rotation.

The fixing device 51 has a driving device for driving the heating roller 2 and the pressurization roller 4. The driving device has a drive source such as a rotation motor (not shown) including a rotation shaft 15 arranged at outside the coil 9. A rotation force is transmitted from the drive source via a rotation transfer member to the pressurization roller 4 and the heating roller 2.

The rotation transfer section of the fixing device 51 is configured such that one of the rotation shafts 23 of the pressurization roller 4 is supported on the bearing part 24 of the supporting device 5 and projects from the outer face of the supporting device 5. The projection is connected to the rotation shaft 15 of a drive motor (not shown) through a gear 25. Accordingly, a rotation force in an R direction is transferred from the drive motor to the pressurization roller 4 and the outer peripheral surfaces of the pressurization roller 4 and the heating roller 2 being in contact with each other, so that the heating roller 2 rotates in conjunction in a Q direction.

Now the advantages of the fixing device according to the fourth embodiment will be described.

According to the fixing device of the fourth embodiment, the coil 9 is wound like a tube via the gap along the outer periphery of the heating roller 2 containing both ends of the heating roller 2 in the axial direction orthogonal to the rotation direction of the heating roller 2 and both sides parallel with the axial direction, and at least a part of the heating roller 2 is positioned inside the tubular part of the coil 9, so that change in the heating efficiency of heating the heating roller 2 is small and temperature variations on the surface of the heating roller 2 can also be decreased.

The fixing device 51 has the drive source having the rotation shaft 15 outside the coil 9, and the driving device is configured so as to transfer the rotation force from the drive source via the gear 25 to the heating roller 2 and the pressurization roller 4, so that the coil 9 can be wound in a small diameter via the gap along the outer periphery of the heating roller 2 without being limited by the space wherein the driving device is placed, and miniaturization and space saving are made possible.

According to the fixing device 51, the pressurization roller 4 and the heating roller 2 are rotated from one to the other in conjunction, so that additional parts for transferring the rotation are not required, the heat amount loss caused by heat conduction from the heating roller 2 can be decreased, and the heating roller 2 can be heated efficiently. Since additional parts are not required, the structure of the fixing device 51 is simplified and productivity of the fixing device is improved.

According to the fixing device 51, the pressurization roller 4 and the heating roller 2 are pressed against each other in the non-image formation area portions 41 to 44 for transferring the rotation force. Thus, when recording paper P is nipped, rotation can be reliably transferred and an excellent image can be fixed onto the recording paper P.

According to the fixing device 51, the position accuracy of the coil 9 and the heating roller 2 can be kept high, so that temperature variations of the heating roller 2 are small and high heating efficiency can be provided.

Since the support 6, the supporting devices 5, etc., disposed outside the heating roller 2 are made of resins having heat insulating properties, nonmagnetism, nonconductivity, heat resistance, etc., when the heating roller 2 is heated to a high temperature, a temperature rise of the coil 9 can be prevented, an increase in the electric resistance of the coil 9 can be decreased, the support 6 and the supporting devices 5 do not generate heat, and the fixing device 51 having high heating efficiency can be provided.

(Fifth Embodiment)

Subsequently, a fifth embedment of a fixing device 50 of the invention will be described with reference to FIGS. 9A and 9B.

Figure 9B:
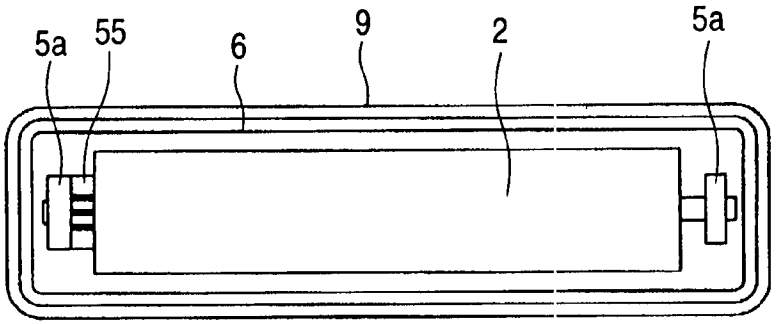
FIG. 9B is a plan view viewed from arrow U direction in FIG. 9A.
Figure 9A:
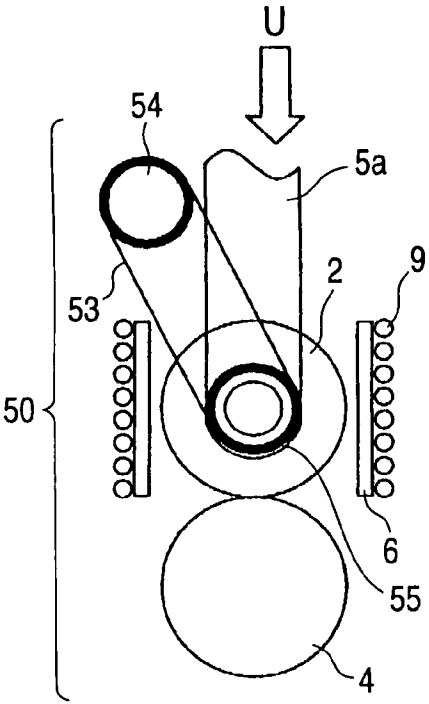
FIG. 9A is an external perspective view showing a configuration of a fixing device according to a fifth embodiment of the invention.

FIGS. 9A and 9B are drawings to show the configuration of the fixing device 50 of the fifth embodiment. FIG. 9A is a drawing to represent the fixing device viewed from the axial direction orthogonal to the rotational direction of a heating body. FIG. 9B is a drawing to represent the fixing device viewed from arrow U direction in FIG. 9A.

The fixing device 50 in the fifth embodiment basically has the same configuration as the fixing device 51 of the fourth embodiment and therefore components common to the fixing device 51 are not shown and will not be discussed again in detail and only features will be discussed.

In FIGS. 9A and 9B, driving device of the fixing device 50 has a drive source (not shown) having a rotation shaft 54 outside a coil 9 wound around the outer periphery of a support 6, and rotation force is transferred from the drive source via rotation transfer section (described later) to a heating roller 2 and a pressurization roller 4. The pressurization roller 4 and the heating roller 2 are supported on supporting devices 5*a* and the support 6 for rotation.

The rotation transfer section of the fixing device 50 is made up of the heating roller 2 including a rotation shaft 55 in an axial end part, the drive source (not shown) such as a rotation motor including the rotation shaft 54, a belt 53 placed on the rotation shafts 54 and 55 for rotation, the supporting device 51 for supporting the rotation shaft 54 of the heating roller 2 for rotation, and the pressurization roller 4 pressed against the heating roller 2. As the rotation shaft 54 of the drive source rotates, the rotation force is transferred via the belt 53 to the rotation shaft 55 of the heating roller 2 and then the rotation force of the heating roller 2 is transferred to the pressurization roller 4, and the heating roller 2 and the pressurization roller 4 are rotated in conjunction.

The belt 53, the rotation shafts 54 and 55, the supporting device 51, and the like are formed using resin material having heat insulating properties, nonconductivity, nonmagnetism, heat resistance, etc.

The advantages of the fixing device of the fifth embodiment will be described.

According to the fixing device of the fifth embodiment, the heating roller 2 and the rotation shaft 54 of the drive source are connected via the belt 53, so that the heat amount loss produced as heat is conducted from the heating roller 2 to the drive source can be decreased, and the heating roller 2 can be heated efficiently.

Since the belt 53, the rotation shafts 54 and 55, the supporting device 51, and the like are formed using resin material having heat insulating properties, nonconductivity, nonmagnetism, heat resistance, etc., if the heating roller 2 is heated to a high temperature, a temperature rise of the coil 9 can be suppressed, an increase in the electric resistance of the coil 9 can be decreased, the support 6 and the supporting device 51 do not generate heat, and the fixing device 50 having high heating efficiency can be provided.

(Sixth Embodiment)

Subsequently, a sixth embedment of a fixing device of the invention will be described with reference to FIG. 10.

Figure 10:
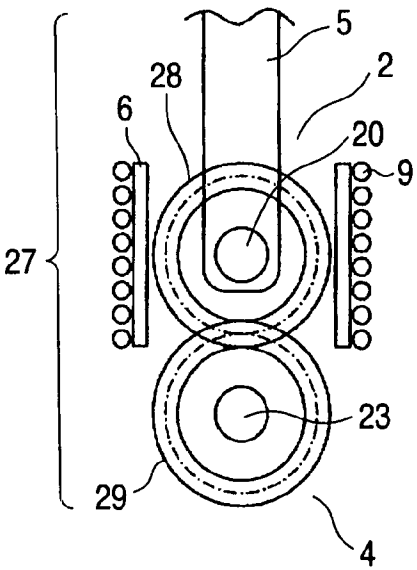
FIG. 10 is a drawing showing a rotation transfer part of a heating roller and a pressurization roller of a fixing device according to a sixth embodiment of the invention.

FIG. 10 is a drawing to show the configuration of a fixing device 27 of the sixth embodiment.

The fixing device 27 in the sixth embodiment basically has the same configuration as the fixing device 51 of the fourth embodiment and therefore components common to the fixing device 51 are not shown and will not be discussed again in detail and only features will be discussed.

In FIG. 10, the fixing device 27 includes a gear 28 fixed to a rotation shaft 20 of a heating roller 2 and a gear 29 fixed to a rotation shaft 23 of a pressurization roller 4. The gears 29 and 28 connect the pressurization roller 4 and the heating roller 2. The rotation shaft 23 of the pressurization roller 4 and the rotation shaft 20 of the heating roller 2 are supported on supporting devices 5 and a support 6 for rotation, as in the fourth embodiment, and the pressurization roller 4 is connected to a rotation shaft 15 of a drive motor (not shown) via the gear 29. Accordingly, rotation force is transferred from the drive motor to the pressurization roller 4, and then rotation force is transferred from the pressurization roller 4 via the gears 28 and 29 to the heating roller 2.

The gears 28 and 29, the rotation shafts 20 and 23, the supporting device 5, and the like are formed using resin material having heat insulating properties, nonconductivity, nonmagnetism, heat resistance, etc.

Now advantages of the fixing device according to the sixth embodiment will be described.

According to the fixing device of the sixth embodiment, the mutual rotation force of the pressurization roller 4 and the heating roller 2 is transferred by the gears 28 and 29, so that rotation of the pressurization roller 4 and the heating roller 2 can be transferred with high accuracy.

Since the gears 28 and 29, the rotation shafts 20 and 23, the supporting device 5, and the like are formed using resin material having heat insulating properties, nonconductivity, nonmagnetism, heat resistance, etc., when the heating roller 2 is heated to a high temperature, a temperature rise of the coil 9 can be prevented, an increase in the electric resistance of the coil 9 can be decreased, the gears 28 and 29, the rotation shafts 20 and 23, the supporting device 5 do not generate heat, and the fixing device 27 having high heating efficiency can be provided.

(Seventh Embodiment)

Subsequently, a seventh embedment of a fixing device of the invention will be described with reference to FIG. 11.

Figure 11:
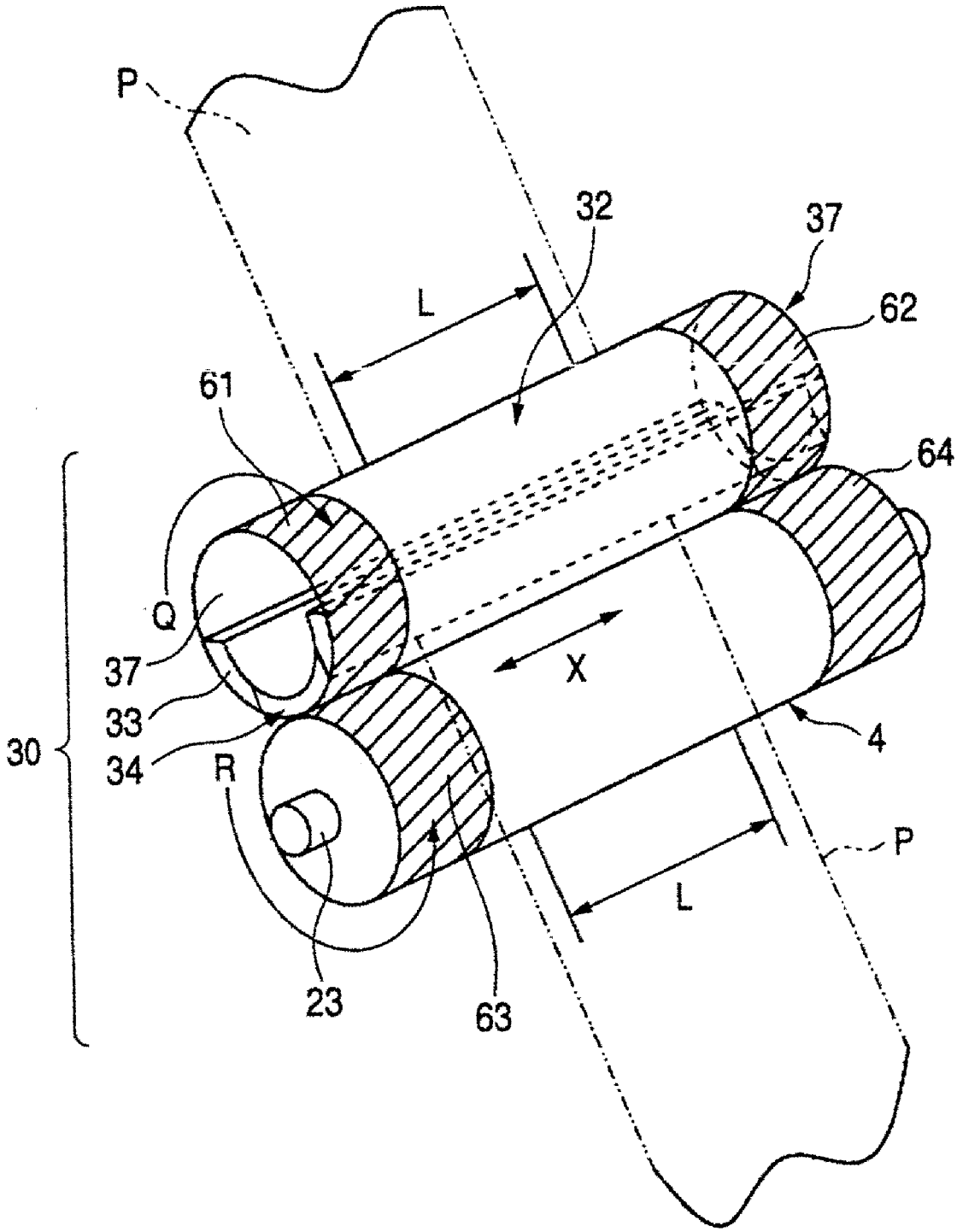
FIG. 11 is an external perspective view showing a configuration of a fixing device according to a seventh embodiment of the invention.

FIG. 11 is a drawing to show the configuration of a fixing device of the seventh embodiment.

A fixing device 30 in the seventh embodiment basically has the same configuration as the fixing device 51 of the fourth embodiment and therefore components common to the fixing device 51 are not shown and will not be discussed again in detail and only features will be discussed.

The fixing device 30 includes a guide body 33 shaped roughly like a semicylinder, a heating body 32 implemented as a tubular film disposed slidably along the outer peripheral surface of the guide body 33, a pressurization roller 4 being disposed in parallel with the heating body 32 in contact with the outer peripheral surface of the heating body 32 for nipping and transporting recording paper P (corresponding to a recording material) with the heating body 32, electromagnetic induction heater (not shown) for heating the heating body 32, and a supporting device (not shown) for supporting the fixing device 30 to a predetermined position of a machine.

The fixing device 30 nips and transports recording paper P to which a developer such as toner has been transferred in a press contact nip part between the heating body 32 and the pressurization roller 4 and fixes the developer such as unfixed toner onto the recording paper P.

The heating body 32 is formed of a thin metal film having conductivity and magnetism (for example, a film of carbon steel, nickel, stainless steel, etc., 50 μm thick) for the electromagnetic induction heater (not shown) to heat the heating body 32.

The heating body 32 is fitted onto the guide body 33 slidably along the outer peripheral surface of the guide body 33 shaped roughly like a semicylinder.

The heating body 32 is disposed so that the outer peripheral surface along an axial direction X comes in contact with the pressurization roller 4. Rotation of the pressurization roller 4 is transferred to the heating body 32, which then is rotated (in a Q direction in FIG. 8) along the outer peripheral surface of the guide body 33.

The heating body 32 and the pressurization roller 4 are formed on the outer peripheral surfaces with image formation area portions (ranges of L in the figure) for nipping an image formation area of recording paper P therebetween and non-image formation area portions 61 and 62 and 63 and 64 outside the image formation area of recording paper P, outside both sides of each image formation area portion.

The non-image formation area portions 61 and 62 of the heating body 32 have each a film thickness slightly larger than that of each image formation area portion, the outer diameter of each of the non-image formation area portions 63 and 64 of the pressurization roller 4 is formed slightly larger than the outer diameter of the image formation area portion, and each of the non-image formation area portions 61 to 64 is formed on the surface with a non-slip portion in a large face roughness degree so as to increase a friction coefficient. In the non-image formation area portions 61 to 64, the rotation force of the pressurization roller 4 is reliably transferred to the heating body 32.

The non-image formation area portion has a larger thickness than the image formation area portion has, so that the image formation area portion is not worn by transfer of rotation.

One of rotation shafts 23 of the pressurization roller 4 is connected to a rotation shaft of a drive motor (not shown) through a gear as in the fourth embodiment. Accordingly, a rotation force in an R direction is transferred from the drive motor to the pressurization roller 4, the outer peripheral surface of the pressurization roller 4 and the outer peripheral surface of the heating body 32 come in contact with each other, and the rotation force for a circular move (in the Q direction in FIG. 8) is transferred to the heating body 32.

To enhance the heating efficiency of the electromagnetic induction heater, the guide body 33 is made of a resin having heat insulating properties, nonmagnetism, nonconductivity, heat resistance, etc.

The guide body 33 is formed with a nip part 34 as a smooth face and the heating body 32 can well slide.

Outside the heating body 32, the electromagnetic induction heater having a coil 9 wound like a tube via a gap along the outer periphery of the heating body 32 containing both ends 37 of the heating body 32 in the axial direction thereof orthogonal to the rotational direction of the heating body 32 and both sides parallel with the axial direction is formed as in the fourth embodiment. More than half of the circumferential face of the heating body 32 (heating area) is positioned in the tubular part of the coil 9.

Now the advantages of the fixing device according to the seventh embodiment will be described.

Since the fixing device of the seventh embodiment has the heating body 32 implemented as a film, the heat capacity to raise the heating body 32 to the fixing (fusing) temperature can be decreased and when the electromagnetic induction heater is activated, the fixing (fusing) temperature can be obtained promptly and temperature variations of the heating body 32 can be decreased and efficient heating can be accomplished.

The pressurization roller 4 and the heating body 32 are pressed against each other in the non-image formation area portions 61 to 64, thereby transferring the rotation force. Thus, if recording paper P is nipped, rotation can be reliably transferred and an excellent image can be fixed onto the recording paper P.

Although the invention has been described in its preferred embodiments, it is to be understood that the invention is not limited to the specific embodiments thereof and various modifications can be made.

For example, according to the fixing device 51 of the fourth embodiment, the coil 9 is wound around the outer peripheral surface of the tubular support 6 having both parallel side walls 11 and 12 and the tubular coil 9 is formed so as to have both side walls parallel along both sides in the axial direction of the heating roller 2 as shown in FIGS. 2 and 4, but the support 6 may be formed as a shape bent along the heating roller 2 and the coil 9 may be wound around the outer peripheral surface of the support 6, thereby disposing the coil 9 bent along both sides in the axial direction of the heating roller 2 as shown in FIG. 5.

The support 6 is formed so as to cover the heating roller 2 like a tube, but may be formed so as to further cover the pressurization roller 4. At the time, the support 6 is formed with a slit for delivering recording paper to the nip part.

Although the coil 9 is wound around the outer peripheral surface of the support 6, if the effect of radiant heat from the heating roller 2 is small, the coil 9 may be wound around the inner surface of the support 6.

The coil 9 is formed using litz wire of a plurality of conductors for making the surface area large, thereby suppressing an increase in the resistance value caused by the skin effect, but a single wire formed with asperities on the surface may be used to make the surface area large.

According to the fixing device 51 of the fourth embodiment, ceramic powder may be applied to the non-image formation area portions 41 to 44 of the heating roller 2 and the pressurization roller 4 to provide surfaces having high wear resistance and excellent friction coefficient.

According to the fixing device 50 of the fifth embodiment, the belt is formed using a resin material having heat insulating properties, nonconductivity, nonmagnetism, heat resistance, etc., but may be made of metal or any other inorganic substance if heat insulating properties from the heating roller can be secured.

According to the fixing device 50 of the fifth embodiment, the heating roller 2 and the pressurization roller 4 are connected by the gears 28 and 29 and the rotation force is transferred, but instead of the gears, the rotation shafts may be connected by belt for transferring the rotation force.

According to the fixing device 30 of the seventh embodiment, the heating body 32 is made of a tubular film, but a molded thin pipe may be used.

According to the fixing device 30 of the seventh embodiment, the heating body 32 is formed of a thin metal film (for example, a film of carbon steel, nickel, stainless steel, etc., 50 μm thick), but metal, a metal compound, an organic conductor, etc., having no magnetism may be used.

(Eighth Embodiment)

Subsequently, an eighth embedment of a fixing device of the invention will be described with reference to FIG. 12, 13 and 15A.

A fixing device 81 in the eighth embodiment basically has the same configuration as the fixing device 1 of the first embodiment and therefore components common to the fixing device 1 are not shown and will not be discussed again in detail and only features will be discussed.

Figure 12:
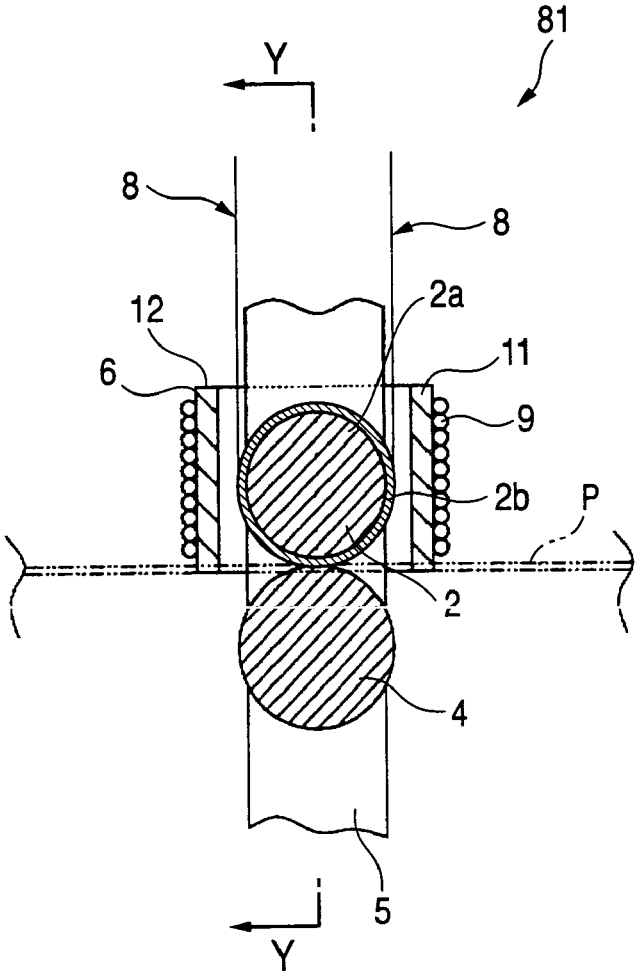
FIG. 12 is a sectional view showing an eighth embodiment of the invention.
Figure 13:
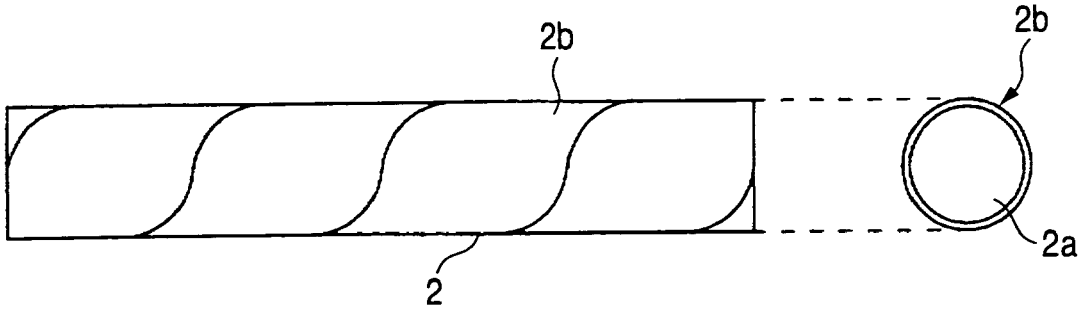
FIG. 13 is an external view showing a winding shape of magnetic metal foil in a heating roller in FIG. 12.
Figure 15A:
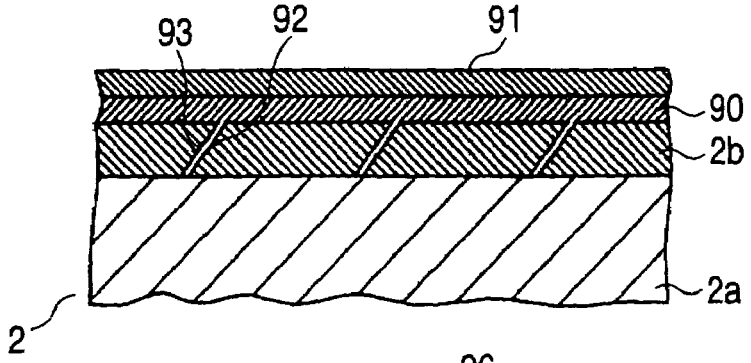
FIG. 15A is a sectional view showing the heating roller in FIG. 12 and FIGS. 15B to 15E are sectional views showing modifications thereof.

FIG. 12 is a sectional view corresponding to FIG. 4, FIG. 13 is an external view to show the winding shape of magnetic metal foil of a heating roller in FIG. 12, and FIG. 15A is a sectional view to show the heating roller in FIG. 12.

The fixing device 81 includes a heating roller 2 and a pressurization roller 4 having surfaces being pressed against each other for rotating, an electromagnetic induction heater 3 for heating the heating roller 2 from the outside, and supporting devices 5 for supporting the fixing device 1 to a predetermined position of a machine. The fixing device 1 nips and transports recording paper P to which a developer such as toner has been transferred in a press contact nip part between the heating roller 2 and the pressurization roller 4 and fixes the unfixed developer onto the recording paper P.

The heating roller 2 includes rotation shafts 20 projected at both end parts 7 and the rotation shafts 20 are supported on bearings 13 formed on the support 6 for rotation.

Recording paper P (corresponding to a recording material) is nipped between the outer peripheral surface of the heating roller 2 and the outer peripheral surface of the pressurization roller 4 and as the heating roller 2 and the pressurization roller 4 rotate, the recording paper P is transported in the rotation direction.

As shown in FIG. 13, a cylindrical support part 2*a* made of a heat insulating material and an elastic substance is fixed to the rotation shafts 20 of the heating roller 2 and magnetic metal foil 2*b* (electromagnetic induction heat generation layer) is wound around the surface of the cylindrical support part 2*a* in a spiral fashion.

Further, the heating roller 2 is formed by depositing a heat conduction layer 90 on the top of the magnetic metal foil 2*b* and depositing a developer release layer 91 on the top of the heat conduction layer 90, as shown in FIG. 15A. The magnetic metal foil 2*b* is formed using a material having conductivity and magnetism (for example, a film of carbon steel, nickel, stainless steel, etc., 50 μm thick) for the electromagnetic induction heater 3 to heat the heating roller 2. Both side edges along the length direction of strip have inclined faces 92 and 93 in the thickness direction and the magnetic metal foil 2*b* is wound around the cylindrical support part 2*a* so that the inclined faces 92 and 93 overlap in the thickness direction.

The cylindrical support part 2*a* is made of a resin having heat insulating properties, nonmagnetism, nonconductivity, heat resistance, etc., so that the surface of the heating roller 2 can be heated efficiently, and having elasticity so that recording paper P can be stripped easily from the heating roller 2.

The heat conduction layer 90 is formed by applying a coat of metal paste having high heat conductivity to the top of the magnetic metal foil 2*b* and baking the metal paste.

The developer release layer 91 is formed by applying fluorocarbon resin, silicone resin, etc., providing smooth release properties for the developer fixed on a recording material to the top of the heat conduction layer 90.

To enhance the heating efficiency of the electromagnetic induction heater 3, the pressurization roller 4 is made of a resin having heat insulating properties, nonmagnetism, nonconductivity, heat resistance, etc.

The pressurization roller 4 is disposed so as to come in contact with the heating roller 2 along the outer peripheral surface of the cylindrical shape of the heating roller 2 and the rotation shafts 23 formed at both ends is supported on the bearing parts 24 formed in the supporting devices 5 for rotation. Recording paper P can be nipped and transported between the outer peripheral surfaces of the pressurization roller 4 and the heating roller 2.

One of the rotation shafts 23 of the pressurization roller 4 is supported on the bearing part 24 of the supporting device 5 and projects from the outer face of the supporting device 5 and is connected to a rotation shaft 15 of a drive motor (not shown) through a gear 25. Accordingly, a rotation force in an R direction is transferred from the drive motor to the pressurization roller 4 and the outer peripheral surfaces of the pressurization roller 4 and the heating roller 2 come in contact with each other, so that the heating roller 2 rotates in conjunction in a Q direction.

The electromagnetic induction heater 3 is made up of a support 6 extending like a tube along the outer periphery of the heating roller 2 containing both ends 7 in an axial direction X orthogonal to the rotation direction Q of the heating roller 2 and both sides 8 parallel with the axial direction outside the heating roller 2, a coil 9 wound around the outer face of the support 6 so as to contain a center axis of the heating roller 2 inside the tubular part, and an exciting circuit section 18 for applying an alternating current to the coil 9.

An alternating current is allowed to flow into the coil 9, so that an eddy current flows along the surface of the magnetic metal foil 2*b* of the heating roller 2 and is converted into heat for heating the heating roller 2.

To enhance the heating efficiency of the electromagnetic induction heater 3, the support 6 is made of a heat-resistant resin having heat insulating properties, nonmagnetism, nonconductivity, etc.

The support 6 is formed with side walls 11 and 12 extending like a tube along the outer periphery of the heating roller 2 containing both ends 7 in the axial direction orthogonal to the rotation direction Q of the heating roller 2 and both sides 8 parallel with the axial direction. The side walls 11 and 12 of the support 6 shaped like a tube are formed in parallel along both sides 8 in the axial direction of the heating roller 2 and the coil 9 is wound like a tube along the outer peripheral surfaces of the side walls 11 and 12, as shown in FIG. 12.

To support the heating roller 2 for rotation and maintain the relative positions of the heating roller 2 and the pressurization roller 4 with high accuracy, the support 6 is formed with the bearing 13 for supporting the rotation shaft 20 of the heating roller 2 and the rotation shaft 20 of the heating roller 2 is inserted into the bearing 13.

The support 6 has corners 17 of the tubular part positioned on the sides of both ends 7 of the heating roller 2 in the axial direction thereof, the corners 17 being formed each like a curve so that the coil 9 can be wound like a curve from both ends 7 in the axial direction orthogonal to the rotation direction of the heating roller 2 to both sides 8 parallel with the axial direction.

To suppress an increase in the resistance value of the coil 9, the coil 9 is formed using strained wire made up of a plurality of conductors each covered with an insulating film of enamel, etc., for example.

The coil 9 is wound like a tube along the outer peripheral surface of the tubular support 6 and is wound like a curve from both ends 7 in the axial direction orthogonal to the rotation direction of the heating roller 2 to both sides 8 parallel with the axial direction.

Since the outer peripheral surfaces of both side walls 11 and 12 of the support 6 around which the coil 9 is wound are formed so that they are parallel with each other, the coil 9 is formed like a tube with side walls opposed to each other in parallel along both sides 8 in the axial direction of the heating roller 2.

To enhance the heating efficiency of the electromagnetic induction heater 3, the supporting device 5 is made of a resin having heat insulating properties, nonmagnetism, nonconductivity, heat resistance, etc.

The supporting device 5 is placed on the sides of both ends 7 of the heating roller 2 in the axial direction thereof and inside the support 6, and includes a joint part 22 for joining to the support 6 and a bearing part 24 for supporting a rotation shaft 23 of the pressurization roller 4 (described later). The extension tip of the supporting device 5 is fixed to a cabinet (not shown). The fixing device 1 is installed at a predetermined position of a machine, such as an image forming apparatus, via the supporting device 5.

Now the advantages of the fixing device according to the eighth embodiment will be described.

According to the fixing device 81 of the eighth embodiment, the magnetic metal foil 2*b* of a strip is wound around the surface of the cylindrical support part 2*a* of the heating roller 2 in a spiral fashion, so that the electromagnetic induction heat generation layer can be formed easily and the productivity of the heating roller 2 can be improved. Since the magnetic metal foil 2*b* subjected to electromagnetic induction heating can be formed like a thin film, the heat capacity can be lessened and after the electromagnetic induction heater 3 is started, a fixing-possible temperature can be provided promptly and high heating efficiency can be provided.

According to the fixing device 81 of the eighth embodiment, the cylindrical support part 2*a* of the heating roller 2 is formed of an elastic substance and the magnetic metal foil 2*b* of a strip is wound around the outer peripheral surface of the cylindrical support part 2*a* in a spiral fashion for forming the heating roller 2, so that recording paper P can be stripped easily from the surface of the heating roller 2 and can be nipped and transported in a good condition.

According to the fixing device 81 of the eighth embodiment, the cylindrical support part 2*a* of the heating roller 2 is formed using a heat insulating material, so that heat conduction from the magnetic metal foil 2*b* to the cylindrical support part 2*a* can be suppressed. After the electromagnetic induction heater 3 is activated, the heating roller 2 reaches a fixing-possible temperature faster.

According to the fixing device 81 of the eighth embodiment, the magnetic metal foil 2*b* of a strip is wound around the surface of the cylindrical support part 2*a* of the heating roller 2 in a spiral fashion, so that the electromagnetic induction heat generation layer can be formed easily. Since the magnetic metal foil 2*b* can be used to form the electromagnetic induction heat generation layer as a thin film, the heat capacity of the electromagnetic induction heat generation layer can be lessened. When the electromagnetic induction heater 3 is activated, the surface of the heating roller 2 reaches a fixing-possible temperature promptly and a fixing device excellent in heating efficiency can be provided.

The magnetic metal foil 2*b* of the heating roller 2 is formed with the inclined faces 92 and 93 in both side edges and is wound so that the inclined faces 92 and 93 overlap, so that a non-heat-generation portion along the axial direction of the heating roller 2 does not occur, the heat generation distribution on the surface of the heating roller 2 is uniform, and the heating roller 2 can be heated efficiently.

According to the fixing device 81 of the eighth embodiment, the heat conduction layer 90 is formed on the surface of the magnetic metal foil 2*b* and further the developer release layer 91 is formed on the surface of the heat conduction layer 90, so that temperature variations on the surface of the heating roller 2 can be decreased and after developer is fixed onto recording paper P, the recording paper P can be easily stripped from the heating roller 2.

The fixing device of the eighth embodiment has the support 6 extending like a tube along the outer periphery of the heating roller 2 containing both ends 7 of the heating roller 2 in the axial direction thereof and both sides 8 parallel with the axial direction, at least a part of the heating roller 2 is positioned inside the support 6, and the coil 9 is wound around the outer peripheral surface of the support 6, so that the coil 9 can be easily wound, the position accuracy of the coil 9 and the heating roller 2 can also be made high, and the fixing device 1 with small temperature variations on the surface of the heating roller 2 and having high heating efficiency can be provided.

Since the support 6, the supporting devices 5, etc., disposed outside the heating roller 2 are made of resins having heat insulating properties, nonmagnetism, nonconductivity, heat resistance, etc., when the heating roller 2 is heated to a high temperature, a temperature rise of the coil 9 can be prevented, an increase in the electric resistance of the coil 9 can be decreased, the support 6 and the supporting devices 5 do not generate heat, and the fixing device 1 having high heating efficiency can be provided.

MODIFIED EXAMPLE

Figure 14:
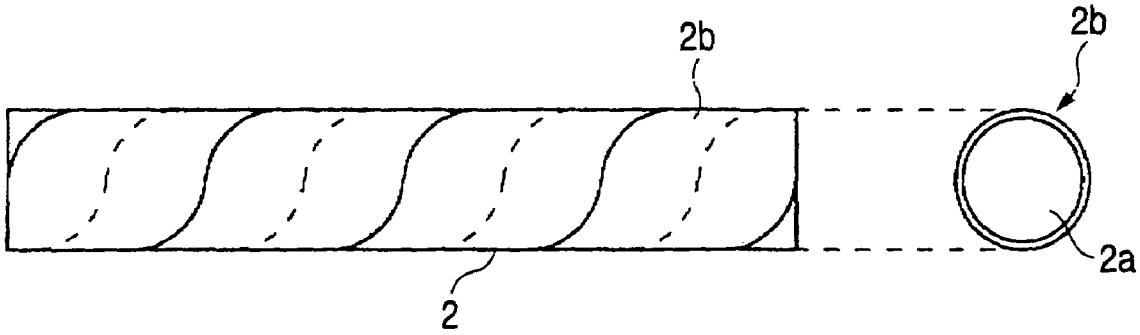
FIG. 14 is an external view showing a modification of the winding shape of magnetic metal foil.

Subsequently, modified examples of the heating roller 2 in the fixing device of the invention will be discussed with reference to FIGS. 14 and 15B to 15E. FIG. 14 is an external view to show a first modification of the heating roller 2 and FIGS. 15B to 15E are sectional views to show second to fifth modifications of the heating roller 2.

First, in a first modification, as shown in FIG. 14, the heating roller 2 is formed by winding magnetic metal foil 2*b* around the surface of the cylindrical support part 2*a* made of an elastic substance in a spiral fashion. The magnetic metal foil 2*b* is made up of a first layer wound around the surface of the cylindrical support part 2*a* in a spiral fashion (indicated by the spiral hidden line in FIG. 14) and a second layer wound around the top face of the first layer in a different spiral fashion (indicated by the spiral solid line in FIG. 6); it is wound so that edge parts of the magnetic metal foil 2*b* in the width direction thereof overlap each other.

According to the first modification, the adjacent parts of the magnetic metal foil 2*b* conduct, a non-heat-generation portion does not occur along the axial direction of the heating roller 2, the heat generation distribution is uniform, and the heating roller 2 can be heated efficiently.

Figure 15B:
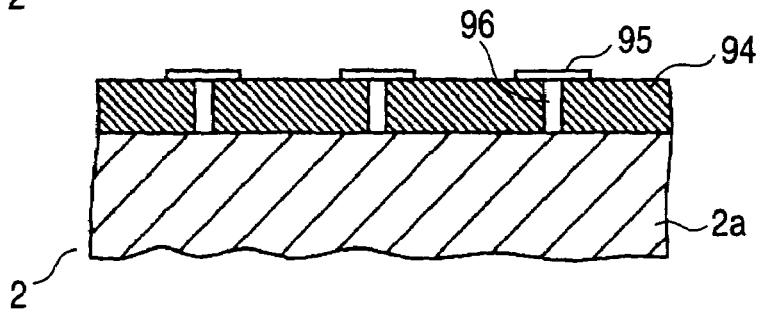

In a second modification, as shown in FIG. 15B, a heating roller 42 is formed by winding magnetic metal foil 2*b* around the surface of the cylindrical support part 2*a* made of an elastic substance in a spiral fashion. On the surface of the cylindrical support part 2*a*, conductive tape 95 is wound along a gap 96 between both adjacent side edges of magnetic metal foil so that the side edges conduct.

According to the second modification, the adjacent parts of the magnetic metal foil 2*b* conduct via the conductive tape 95, a non-heat-generation portion does not occur along the axial direction of the heating roller 42, the heat generation distribution is uniform, and the heating roller 42 can be heated efficiently.

Figure 15C:
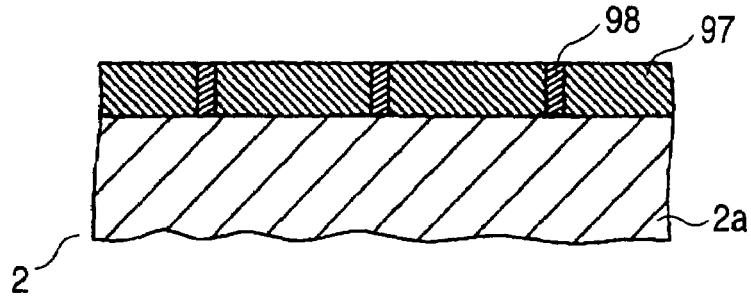

In a third modification, as shown in FIG. 15C, a heating roller 2 is formed by winding magnetic metal foil 2*b* around the surface of the cylindrical support part 2*a* made of an elastic substance in a spiral fashion. On the surface of the cylindrical support part 2*a*, each gap of the magnetic metal foil 2*b* is filled with a conductive filler 98 so that both side edges of the gap conduct.

According to the third modification, the adjacent parts of the magnetic metal foil 2*b* conduct via the filler 98, a non-heat-generation portion does not occur along the axial direction of the heating roller 43, the heat generation distribution is uniform, and the heating roller 2 can be heated efficiently.

Figure 15D:
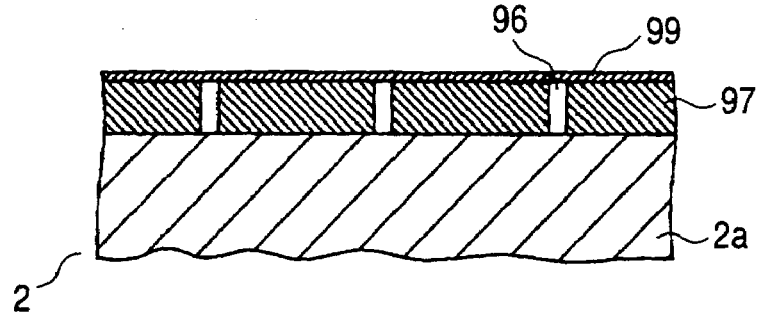

In a fourth modification, as shown in FIG. 15D, a heating roller 2 is formed by winding magnetic metal foil 2*b* around the surface of the cylindrical support part 2*a* made of an elastic substance in a spiral fashion. A heat conduction layer 99 is formed on the surface of the magnetic metal foil 2*b*.

According to the fourth modification, temperature variations on the surface of the heating roller 2 can be decreased.

Figure 15E:
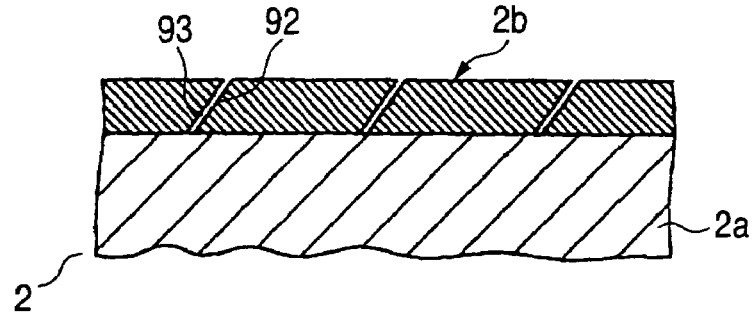

In a fifth modification, as shown in FIG. 15E, heating roller 2 is formed by winding magnetic metal foil 2*b* of a strip around the surface of the cylindrical support part 2*a* made of an elastic substance in a spiral fashion. The magnetic metal foil 2*b* is formed with inclined faces 92 and 93 in both side edges and is wound so that the inclined faces 92 and 93 overlap.

According to the fifth modification, the inclined faces 92 and 93 in both side edges of the magnetic metal foil 2*b* overlap and thus the adjacent parts of the magnetic metal foil 2*b* conduct, a non-heat-generation portion does not occur along the axial direction of the heating roller 2, the heat generation distribution is uniform, and the heating roller 2 can be heated efficiently.

In a sixth modification (not shown), heating roller 2 is formed by winding magnetic metal foil 2*b* of a strip around the surface of the cylindrical support part 2*a* made of an elastic substance so that edge parts of the magnetic metal foil 2*b* in the width direction thereof overlap each other.

According to the sixth modification, the adjacent parts of the magnetic metal foil 2*b* conduct, a non-heat-generation portion does not occur along the axial direction of the heating roller 2, the heat generation distribution is uniform, and the heating roller 2 can be heated efficiently.

Although the invention has been described in its preferred embodiments, it is to be understood that the invention is not limited to the specific embodiments thereof and various modifications can be made.

For example, according to the fixing device of the eighth embodiment, the two layers of the heat conduction layer 90 and the release layer 91 are deposited on the surface of the magnetic metal foil 2*b* of the heating roller 2. However, for example, a conductive filler may be mixed into fluorocarbon resin and one layer made up of resins providing both heat conductivity and releasability may be deposited.

According to the fixing device of the eighth embodiment, magnetic metal foil is used as the electromagnetic induction heat generation layer, but may be a sheet of any other inorganic substance if it provides electromagnetic induction heat generation and has high heating efficiency. For example, a graphite sheet having magnetism and excellent heat conductivity or the like may be used.

Although the coil 9 is wound around the outer peripheral surface of the support 6, if the effect of radiant heat from the heating roller 2 is small, the coil 9 may be wound around the inner surface of the support 6.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fixing device, comprising:

a heating body that rotates about a longitudinal axis; and an electromagnetic induction heater including a coil wound about a winding axis to form a tubular part, the coil wound along an outer periphery of the heating body to surround both ends of the heating body, the ends positioned in an axial direction orthogonal to a rotational direction of the heating body and to surround both sides of the heating body, the sides positioned parallel with the axial direction, wherein the winding axis is substantially perpendicular to the longitudinal axis of the heating body, and wherein at least a part of the heating body is positioned inside the tubular part of the coil.

2. The fixing device as claimed in claim 1, wherein the heating body comprises a heating roller, and the coil is wound so as to contain a center axis of the heating roller inside the tubular part of the coil.

3. The fixing device as claimed in claim 1, wherein the heating body comprises a film, and the coil is wound so that more than half of a heating area of the film is positioned inside the tubular part of the coil.

4. The fixing device as claimed in claim 1, wherein the heating body comprises a heating roller, and the tubular part of the coil has side walls opposed to in parallel with each other, the side walls extending along the both sides of the heating roller.

5. The fixing device as claimed in claim 1, wherein the coil comprises a litz wire formed of a plurality of conductors each covered with an insulating film.

6. The fixing device as claimed in claim 1, further comprising a support extending like a tube along the outer periphery of the heating body containing both ends in the axial direction orthogonal to the rotational direction and both sides parallel with the axial direction, wherein at least a part of the heating body is positioned inside the support and the coil is wound around an outer face of the support.

7. The fixing device as claimed in claim 6, wherein the support has heat insulating properties.

8. The fixing device as claimed in claim 6, wherein the support has nonmagnetism and nonconductivity.

9. The fixing device as claimed in claim 6, wherein the support has a bearing for the heating body to rotate.

10. The fixing device as claimed in claim 1, wherein portions of the coil are wound in curved shape, the portions extending from both ends of the coil in the axial direction orthogonal to the rotational direction to both sides of the coil parallel with the axial direction.

11. An image forming apparatus, comprising:

a process unit including a developing section, a photosensitive member, and a charger;

a transfer member for transferring a developer on the photosensitive member to a recording material to form an unfixed image on the recording material; and a fixing device for heating and fixing the unfixed image onto the recording material, wherein the fixing device comprises:

a heating roller that rotates about a longitudinal axis;

a support extending to form a tube along an outer periphery of the heating roller to surround both ends of the heating roller, the ends positioned in an axial direction of the heating roller and to surround both sides of the heating roller, the sides positioned parallel with the axial direction; and a coil wound about a winding axis to form a tubular part, the coil wound around an outer face of the support along the outer periphery of the heating roller to surround the ends of the heating roller positioned in the axial direction of the heating roller and to surround the sides of the heating roller positioned parallel with the axial direction, wherein the winding axis is substantially perpendicular to the longitudinal axis of the heating roller.

12. A fixing device, comprising:

a heating body that rotates about a longitudinal axis;

a pressurization roller that rotates in association with the heating body, the pressurization roller and the heating body nipping and transporting a recording material to fix an unfixed developer onto the recording material;

an electromagnetic induction heater including a coil wound about a winding axis to form a tubular part, the coil wound along an outer periphery of the heating body to surround both ends of the heating body, the ends positioned in an axial direction orthogonal to a rotational direction of the heating body and to surround both sides of the heating body, the sides positioned parallel with the axial direction, wherein the winding axis is substantially perpendicular to the longitudinal axis of the heating body, and wherein at least a part of the heating body being positioned inside the tubular part of the coil; and a driving device including a drive source having a rotation shaft outside the coil, the driving device transferring a drive force from the drive source via rotation transfer section to the heating body and the pressurization roller.

13. The fixing device as claimed in claim 12, wherein the rotation transfer section transfers rotation force of the drive source to the pressurization roller via a gear connecting a rotation shaft of the pressurization roller and the rotation shaft of the drive source and further transfers rotation force of the pressurization roller to the heating body.

14. The fixing device as claimed in claim 12, wherein the heating body comprises a heating roller, and the rotation transfer section transfers rotation force of the drive source to the heating roller via a belt connecting the heating roller and the rotation shaft of the drive source and further transfers rotation force of the heating roller to the pressurization roller.

15. The fixing device as claimed in claim 14, wherein the belt is made of a heat insulating material.

16. The fixing device as claimed in claim 12, wherein the pressurization roller and the heating body are pressed against each other to rotate from one to the other in conjunction.

17. The fixing device as claimed in claim 12, wherein the heating body comprises a heating roller, and the fixing device comprises a gear for connecting the pressurization roller and the heating roller and rotation force is transferred between the pressurization roller and the heating roller via the gear.

18. The fixing device as claimed in claim 12, wherein each of the pressurization roller and the heating body comprises a non-image formation area portion not nipping the recording material, and the rotation transfer section presses the pressurization roller and the heating body against each other in the non-image formation area portions.

19. The fixing device as claimed in claim 18, wherein the non-image formation area portion of the pressurization roller has a larger outer diameter than that of an image formation area portion of the pressurization roller.

20. The fixing device as claimed in claim 18, wherein the heating body comprises a heating roller, and the non-image formation area portion of the heating roller has a larger outer diameter than that of an image formation area portion of the heating roller.

21. The fixing device as claimed in claim 18, wherein the heating body comprises a film, and the non-image formation area portion of the film has a larger thickness than that of an image formation area of the film.

22. The fixing device as claimed in claim 18, wherein the non-image formation area portion is formed with a non-slip portion on a surface thereof so as to increase a friction coefficient.

23. The fixing device as claimed in claim 22, wherein the non-image formation area portion has a surface formed in a large face roughness degree.

24. The fixing device as claimed in claim 12, further comprising a support for supporting the coil and the heating body.

25. An image forming apparatus, comprising:

a process unit including a developing section, a photosensitive member, and a charger;

a transfer member for transferring a developer on the photosensitive member to a recording material to form an unfixed image on the recording material; and a fixing device for heating and fixing the unfixed image onto the recording material, wherein the fixing device comprises:

a heating body that rotates about a longitudinal axis;

a pressurization roller that rotates in association with the heating body, the pressurization roller and the heating body nipping and transporting a recording material to fix the unfixed developer onto the recording material;

an electromagnetic induction heater including a coil wound about a winding axis to form a tubular part, the coil wound along an outer periphery of the heating body to surround both ends of the heating body positioned in an axial direction orthogonal to a rotational direction of the heating body and to surround both sides of the heating body positioned parallel with the axial direction, wherein the winding axis is substantially perpendicular to the longitudinal axis of the heating body, and wherein at least a part of the heating body being positioned inside the tubular part of the coil; and a driving device including a drive source having a rotation shaft outside the coil, the driving device transferring a drive force from the drive source via rotation transfer section to the heating body and the pressurization roller.

* * * * *